US012369655B2

(12) United States Patent
Picone et al.

(10) Patent No.: US 12,369,655 B2
(45) Date of Patent: Jul. 29, 2025

(54) PROTECTIVE PAD ASSEMBLY WITH SELF-RETAINING DEVICE

(71) Applicant: JP Ventures, LLC, Raleigh, NC (US)

(72) Inventors: John A. Picone, Louisburg, NC (US); Joseph M. Pardillo, Raleigh, NC (US)

(73) Assignee: Picone Products L.L.C, Louisburg, NC (US)

( * ) Notice: Subject to any disclaimer, the term of this patent is extended or adjusted under 35 U.S.C. 154(b) by 0 days.

(21) Appl. No.: 18/087,980

(22) Filed: Dec. 23, 2022

(65) Prior Publication Data

US 2023/0284713 A1 Sep. 14, 2023

Related U.S. Application Data

(60) Provisional application No. 63/317,699, filed on Mar. 8, 2022.

(51) Int. Cl.
*A41D 13/05* (2006.01)

(52) U.S. Cl.
CPC ..... *A41D 13/055* (2013.01)

(58) Field of Classification Search
CPC ..... A41D 13/055; A41D 13/065; A63B 71/1225; A63B 2071/125; A63B 2071/1258
See application file for complete search history.

(56) References Cited

U.S. PATENT DOCUMENTS 1,915,753 A 6/1933 O'Shea
2,418,197 A 4/1947 Sherer
3,322,873 A 5/1967 Hitchcock
3,465,365 A * 9/1969 Jones ..... A41D 13/0575 2/24
4,408,600 A 10/1983 Davis
4,561,123 A 12/1985 Hull
4,681,012 A 7/1987 Stelma et al.
4,893,355 A 1/1990 Ritter
5,760,868 A 6/1998 Jannard et al.
6,317,888 B1 * 11/2001 McFarlane ..... A41D 13/065 2/24
6,374,410 B2 4/2002 Adamson
(Continued)

OTHER PUBLICATIONS

International Search Report from Related PCT Application No. PCT/US23/14373 dated May 10, 2023.

*Primary Examiner* — F Griffin Hall
(74) *Attorney, Agent, or Firm* — CALDERON SAFRAN & WRIGHT P.C.

(57) ABSTRACT

A protective pad assembly for removably positioning on an arm or a leg of a user of the protective pad assembly for protecting an elbow or a knee of the user. The protective pad assembly comprises an outer protective unit including a protective cushion pad configured to protect the elbow or the knee of the user from impact, and a self-retaining device mounted to the outer protective unit for retaining the outer protective unit on the arm or leg of the user. The self-retaining device includes a resilient retaining split-ring clamp having two opposite free ends spaced from one another. The free ends of the resilient retaining split-ring clamp are circumferentially expandable or contractable relative to one another for retaining the protective pad on an arm or a leg of the user of the protective pad assembly over one of the elbow and the knee thereof.

22 Claims, 24 Drawing Sheets

(56) References Cited

U.S. PATENT DOCUMENTS

| | | | | |
|---|---|---|---|---|
| 6,988,999 | B1 | 1/2006 | Lin | |
| 7,415,733 | B2 | 8/2008 | Rampersad | |
| 7,618,386 | B2 * | 11/2009 | Nordt, III | A61F 5/0118 602/5 |
| 7,712,150 | B2 | 5/2010 | Pardillo et al. | |
| 7,725,951 | B2 | 6/2010 | Rampersad | |
| 7,861,318 | B2 | 1/2011 | Grilliot et al. | |
| 8,407,812 | B2 | 4/2013 | Godshaw et al. | |
| 9,237,773 | B2 | 1/2016 | Perlmutter | |
| 10,004,285 | B2 | 6/2018 | Johnson | |
| 2013/0254965 | A1 | 10/2013 | Dhaliwal et al. | |
| 2019/0307184 | A1 * | 10/2019 | Picone | A41D 13/08 |
| 2021/0267285 | A1 | 9/2021 | Picone et al. | |
| 2021/0379475 | A1 | 12/2021 | Dierkes et al. | |
| 2022/0061417 | A1 | 3/2022 | Jones | |

* cited by examiner

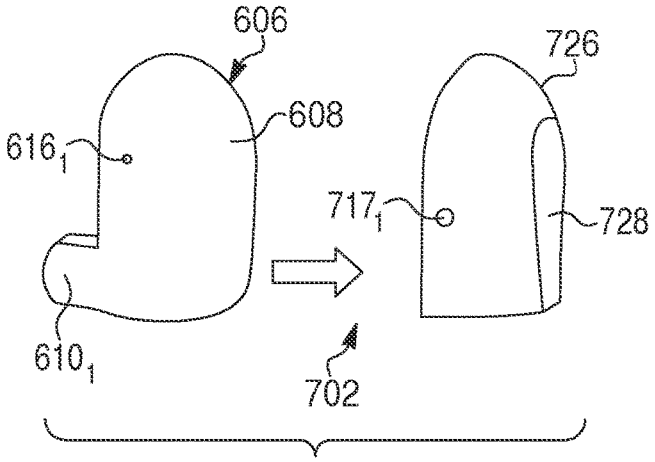
FIG. 56
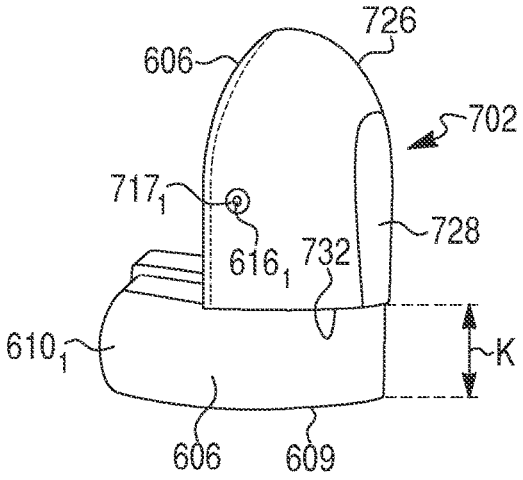
FIG. 57
FIG. 58
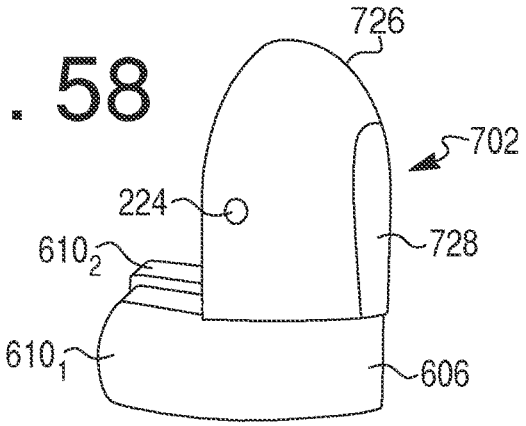
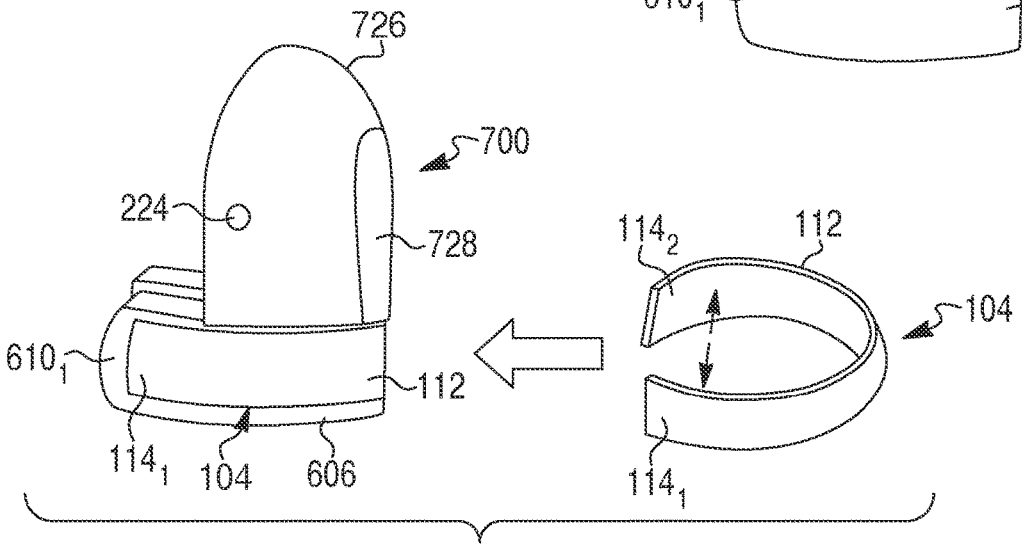
FIG. 59

PROTECTIVE PAD ASSEMBLY WITH SELF-RETAINING DEVICE

CROSS-REFERENCE TO RELATED APPLICATION AND CLAIM TO PRIORITY

This application claims the benefit of U.S. Provisional Patent Application Ser. No. 63/317,699 filed Mar. 8, 2022 by Picone et al., which is incorporated herein by reference in its entirety and to which priority is claimed.

BACKGROUND OF THE INVENTION

1. Field of the Invention

The present invention relates to protective cushioning devices in general and, more particularly, to a protective pad assembly including an outer protective unit and a self-retaining device connectable to the outer protective unit and capable of clamping both around a cushion pad and a body part, such as a user's knee and/or elbow joint, and able to suspend and retain the outer protective unit onto a knee or elbow without the use of straps, elastic bands, magnets and/or additional support.

2. Description of the Related Art

Typically, protective pads or cushioning devices, such as kneepads or elbow pads, are attached to a body part of a user over a garment by various methods including belt straps, clips, wraps, elastic stretch material, glues, tapes or adhesives. A common drawback of prior art methods of fastening such products is that they become uncomfortable to the user (wearer) during prolonged usage do to binding, burning and/or chaffing, which may result in irritation to the skin, limb tingling, and bruising, all of which is brought on by constriction of the blood vessels. For example, FIG. 1 shows a known kneepad 1 utilizing straps 3 and 4 to fasten the kneepad 1 to a knee (or knee area) 7 of a leg 6 of a user. The leg 6 of the user includes an upper portion (or thigh portion) 6*a* and a lower portion 6*b* separated by the knee 7. The strap 3 wraps around the upper portion 6*a* of the leg 6, and a strap 4 wraps around the lower portion 6*b* of the leg 6, or above and below the knee 7, as illustrated in FIG. 1. A drawback of such fastening straps 3 and 4 is that they can cause discomfort to the user (wearer) and constriction of blood vessels during prolonged usage, eventually leading to bruising and/or skin irritation. Specifically, the straps 3 and 4 may cause constriction of the blood vessels and eventually may cut and chafe the thigh portion 6*a* and/or the calf portion 6*b*, respectively. Also, occasionally, strapped knee pads fail to stay in place, and ultimately get loose and start to move and fall down on the leg.

FIG. 2 illustrates a sectional view of a kneepad assembly 10 disclosed in U.S. Pat. No. 7,712,150 attached to pants (or trousers) 2. The kneepad assembly 10 includes a flexible inner member 12 in the form of a base cushion made of an impact absorbing material disposed inside the pants 2, and an outer member 14 in the form of a protective cushion made of an impact absorbing material disposed outside the pants 2. Securing devices use magnetic attraction to attach the outer member 14 and the inner member 12 to each other and to the pants 2. Each securing device includes an inner magnetically attractive element 16 attached to the inner member 12, and an outer magnetically attractive element 18 attached to the outer member 14. A drawback to the use of magnetically attractive elements 16 and 18 is that the elements 16 and 18 potentially can slide relative to the garment during use.

FIG. 3 illustrates a protective pad (or kneepad) assembly 20 in the form of an inner pad 22 to be disposed inside the pants 2 for being positioned over an elbow area or a knee 7 of a user (or wearer) 2, and an outer member 24 in the form of a removable outer elastic band disposed outside a garment in alignment with the inner pad 22. The inner pad 22 further comprises a securing device 26 provided for releasably attaching to a securing device 28 of the removable outer elastic band 24, thus releasably attaching the inner pad 22 and the outer elastic band 24 to each other through the material of the pants 2.

In the kneepad assemblies of FIGS. 2 and 3 the protective pads are attached solely to the pants and rely on the integrity of the pants and the position the pants when the pads are attached. However, as the user moves and changes position, the material of the pants also moves and stretches in different directions, such as up or down or sideways, and ultimately changes the position of the protective pads from the original setting. It may become uncomfortable for the user to be required to make frequent readjustments of the protective pads to reposition them for comfort.

FIGS. 4A and 4B illustrate a protective pad assembly 30 configured to protect an elbow of an arm or a knee 7 of a leg 6 of a user (or wearer) from impact, as disclosed in US 2021/0267285. The protective pad assembly 30 comprises an inner support unit in the form of a sleeve (or band) unit 32 to be positioned adjacent to and below the elbow of the arm or the knee 7 of the leg 6 of the user, and an outer protective unit 34 configured to be disposed over the sleeve unit 32 for protecting the elbow or the knee 7 of the user from impact. The outer protective unit 34 includes an outer protective pad 36 with magnetic outer securing components 38, and the sleeve unit 32 reciprocally includes complementary magnetic inner securing components 40 releasably attachable to the outer securing components 38.

Other known protective pad assemblies have the drawback of requiring permanent alterations to the garment fabric and/or damaging the garment fabric, such as by requiring or creating holes in the garment fabric in order to attain proper attachment.

Therefore, there is a need for a protective pad assembly that overcomes drawbacks and shortcomings of the prior art, enhances its performance and advances the art.

SUMMARY OF THE INVENTION

The present invention is directed to a protective pad assembly for removably positioning on an arm or a leg of a user of the protective pad assembly for protecting an elbow or a knee of the user. The protective pad assembly comprises an outer protective unit including a protective cushion pad configured to protect the elbow or the knee of the user from impact, and a self-retaining device mounted to the outer protective unit for retaining the outer protective unit on the arm or leg of the user over one of the elbow and the knee thereof. The self-retaining device includes a resilient retaining split-ring clamp having two opposite free ends spaced from one another so as to define a gap therebetween. The free ends of the resilient retaining split-ring clamp are circumferentially expandable or contractable relative to one another for retaining the protective pad on an arm or a leg of the user of the protective pad assembly over one of the elbow and the knee thereof. The resilient retaining split-ring clamp has a spectrum of inherent preloaded tensions configured to clamp the resilient retaining split-ring clamp around the arm or leg of the user to retain the protective pad on to the arm or leg of the user over one of the elbow and the knee thereof solely by a resilient force of the resilient retaining split-ring clamp.

The protective pad assembly in accordance with the present invention makes the wearing of protective pad assemblies easier and faster to put on and more comfortable and minimizes the risk of blood clots and nerve damage due to the strangulation effect of straps tightly pulled around user's limb.

Other aspects of the invention, including system, devices, methods, and the like which constitute parts of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed considering the accompanying drawings, in which like elements are given the same or analogous reference numerals. In these drawings:

FIG. 56 shows steps of a process of mounting a flexible short hard cap to a protective cushion pad to form the protective pad assembly in accordance with the seventh exemplary embodiment of the present invention;

FIG. 57 is a perspective view of the outer protective unit in accordance with the seventh exemplary embodiment of the present invention, wherein the protective cushion pad and the flexible short hard cap are not connected with snap fasteners;

FIG. 58 is a perspective view of the outer protective unit in accordance with the seventh exemplary embodiment of the present invention;

FIG. 59 shows steps of a process of mounting a self-retaining device to the outer protective unit to form the protective pad assembly in accordance with the seventh exemplary embodiment of the present invention;

DETAILED DESCRIPTION OF PREFERRED EMBODIMENTS

Figure 2:
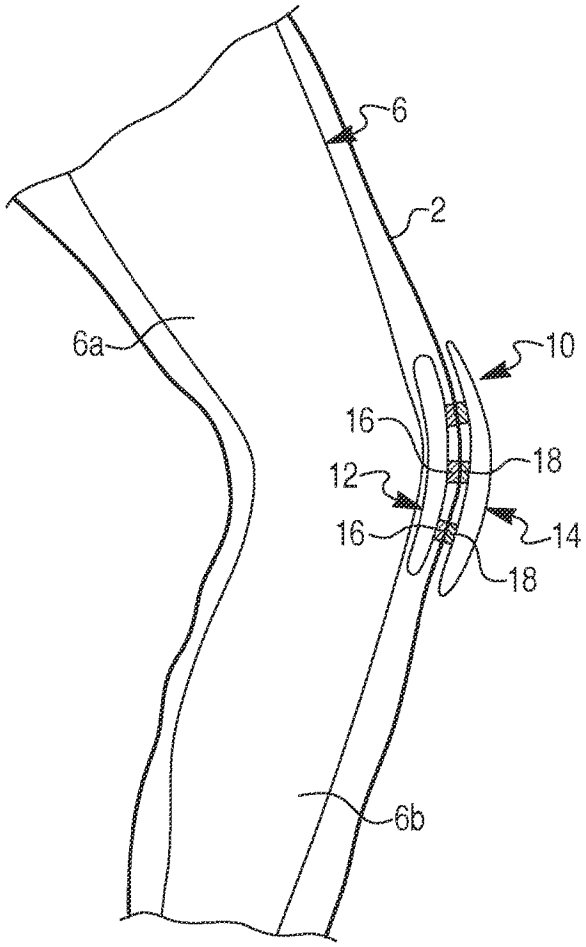
FIG. 2 Prior Art
FIG. 2 illustrates a knee pad assembly with an inner and outer member held together on pants by magnetic attraction of the prior art.
Figure 1:
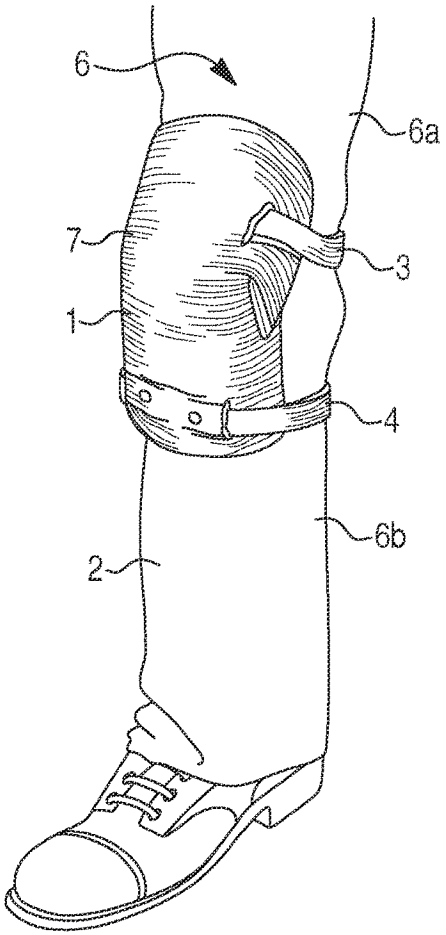
FIG. 1 Prior Art
FIG. 1 illustrates a knee pad assembly with straps of the prior art.
Figure 3:
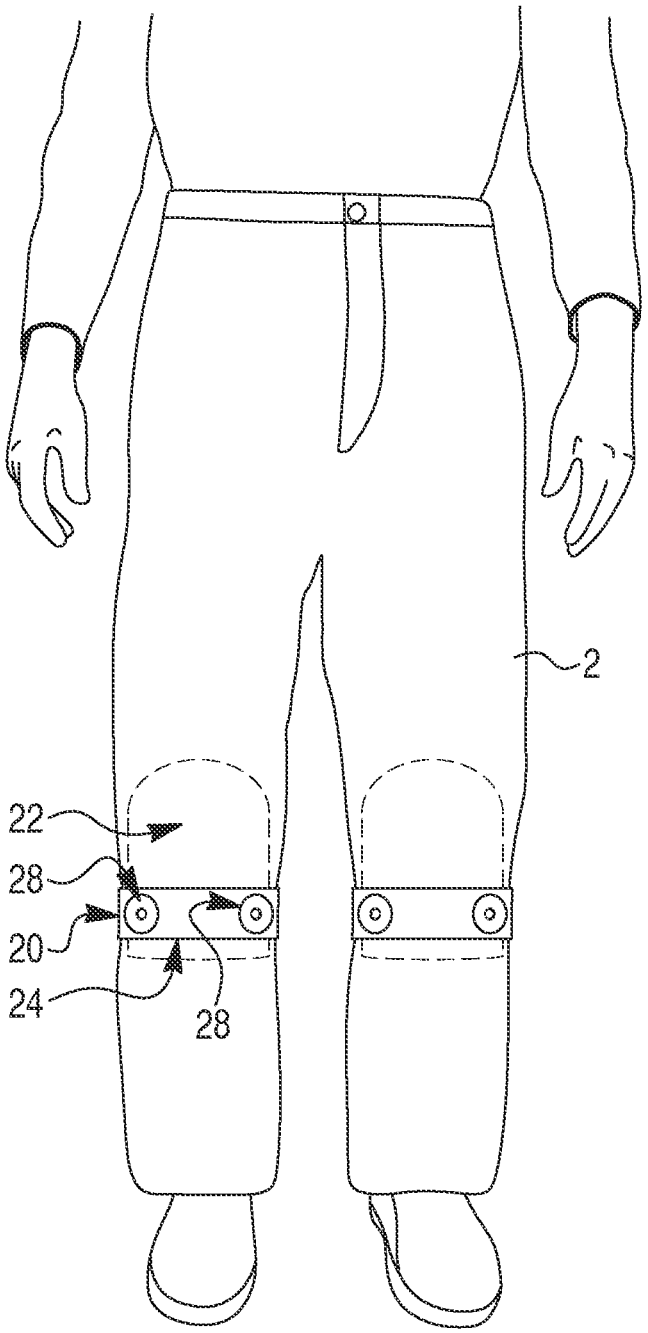
FIG. 3 Prior Art
FIG. 3 illustrates a knee pad assembly with an inner member and an outer magnetic band held together on pants by magnetic attraction of the prior art.
Figure 4A:
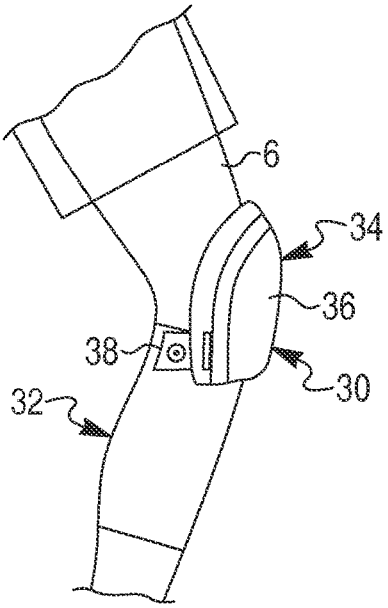
FIG. 4A Prior Art
FIGS. 4A and 4B illustrates a protective pad assembly of the prior art including an outer protective unit and a sleeve unit held together by magnetic attraction.
Figure 4B:
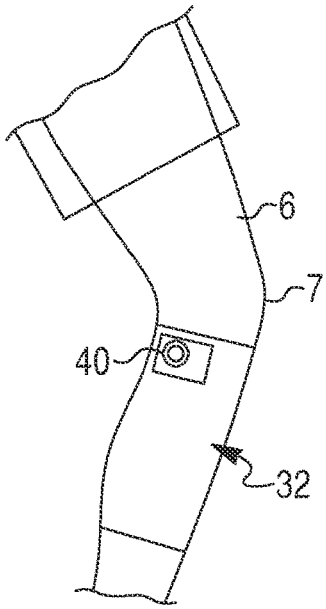
FIG. 4B Prior Art

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods. This description of exemplary embodiments is intended to be read in connection with the accompanying drawings, which are to be considered part of the entire written description. In the description, relative terms such as "inner" and "outer", "inside" and "outside," "horizontal" and "vertical," "front" and "rear," "upper" and "lower," "top" and "bottom" as well as derivatives thereof (e.g., "horizontally," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. Additionally, the words "a" and/or "an" as used in the claims mean "at least one" and the word "two" as used in the claims mean "at least two". For the purpose of clarity, some technical material that is known in the related art has not been described in detail in order to avoid unnecessarily obscuring the disclosure.

Figure 5A:
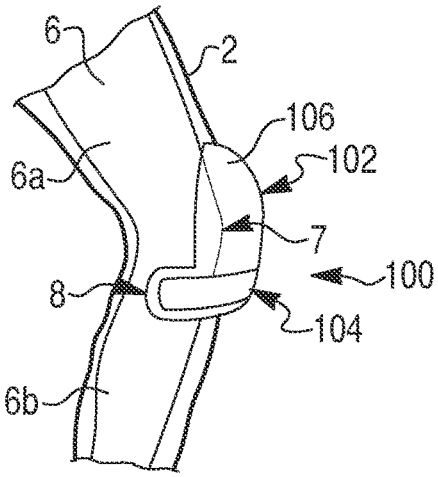
FIG. 5A shows a protective pad assembly in accordance with a first exemplary embodiment of the present invention mounted to a leg of a user wearing pants.
Figure 5B:
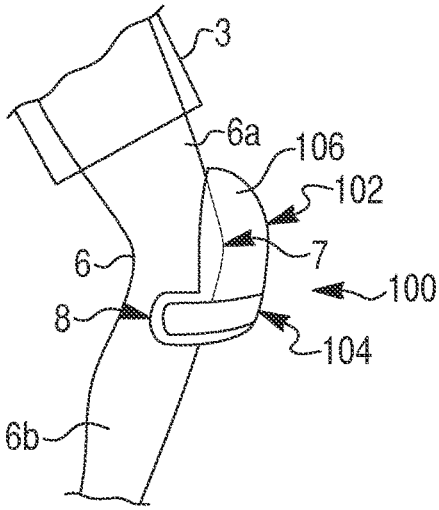
FIG. 5B shows a protective pad assembly in accordance with a first exemplary embodiment of the present invention mounted to a leg of a user wearing shorts.

FIGS. 5A and 5B illustrate a first exemplary embodiment of a protective pad assembly 100 configured to protect an elbow of an arm or a knee 7 of a leg 6 of a user (or wearer) from impact. The leg 6 of the user includes an upper portion (or thigh portion) 6*a* and a lower portion 6*b* (or calf portion) separated by the knee 7. The protective pad assembly 100 comprises an outer protective (or protective pad) unit 102 configured to protect the elbow or the knee of the user from impact, and a self-adjustable, self-retaining device 104 removably attachable to the outer protective unit 102.

Figure 6:
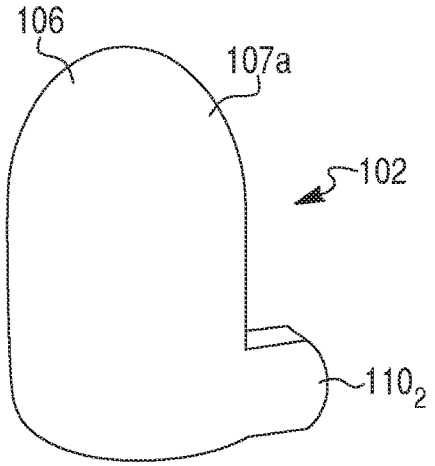
FIG. 6 is a front perspective view of an outer protective unit in accordance with the first exemplary embodiment of the present invention.
Figure 7:
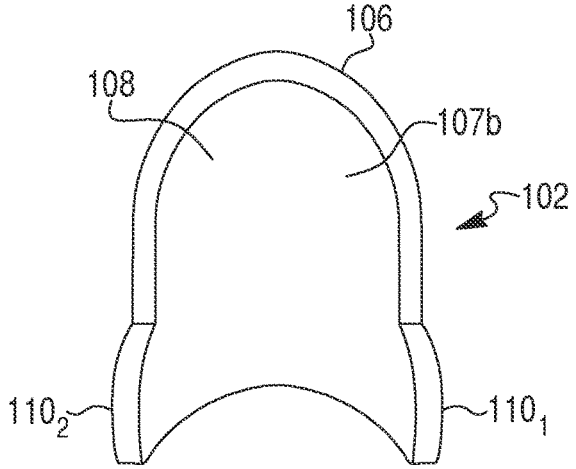
FIG. 7 is a rear perspective view of the outer protective unit in accordance with the first exemplary embodiment of the present invention.

According to the first exemplary embodiment, the outer protective unit 102 includes a flexible (or elastic, resilient) protective cushion pad 106, preferably fabricated from ethylene-vinyl acetate (EVA) material, which is the copolymer of ethylene and vinyl acetate. The protective cushion pad 106 is provided to be disposed outside trousers (pants) 2, as shown in FIG. 5A. The protective cushion pad 106 has a concave central cushion member (or portion) 108 and two (2) flexible side cushion members (or portions) $\mathbf{110}_1$ and $\mathbf{110}_2$ outwardly extending from opposite sides of the central cushion member 108 and formed integrally therewith, as best shown in FIGS. 6 and 7. FIG. 6 shows an outer surface 107*a* of the protective cushion pad 106, while FIG. 7 shows an inner surface 107*b* of the protective cushion pad 106. As best shown in FIGS. 5A, 5B and 11-16, the self-retaining device 104 is removably mounted to the protective cushion pad 106 of the outer protective unit 102, including the central cushion member 108 and the flexible side cushion members $\mathbf{110}_1$ and $\mathbf{110}_2$.

Figure 8:
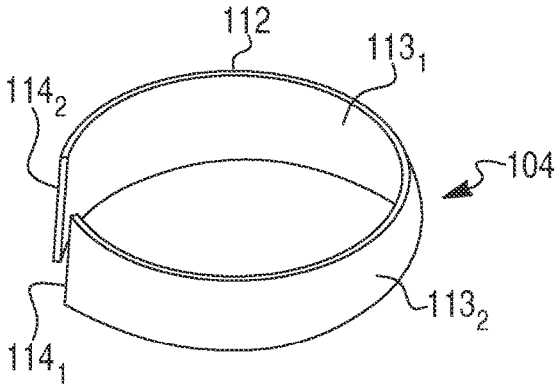
FIG. 8 is a perspective view of a resilient retaining split-ring clamp of a self-retaining device in accordance with the first exemplary embodiment of the present invention.
Figure 9:
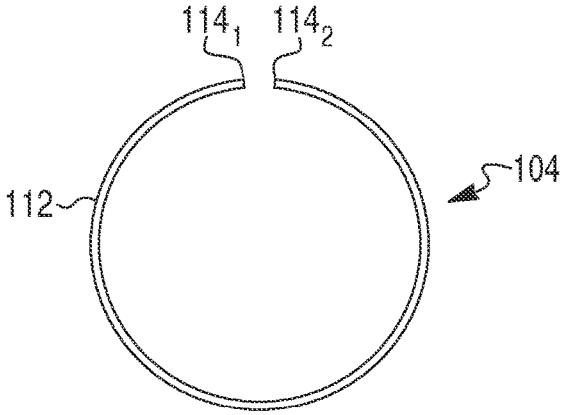
FIG. 9 is a top view of the resilient self-retaining split-ring clamp.
Figure 10:
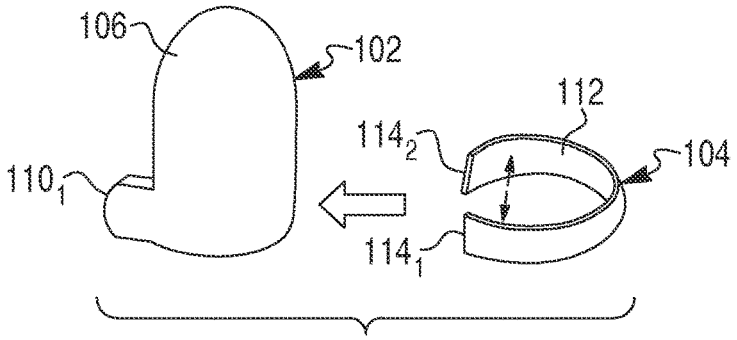
FIG. 10 shows steps of a process of mounting a self-retaining device to an outer protective unit to form the protective pad assembly in accordance with the first exemplary embodiment of the present invention.
Figure 11:
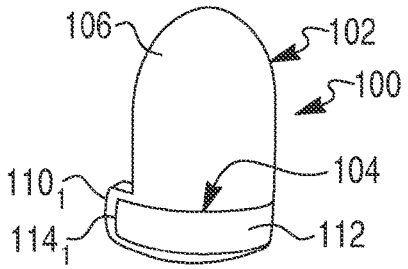
FIG. 11 is a perspective front view of the protective pad assembly in accordance with the first exemplary embodiment of the present invention.
Figure 12:
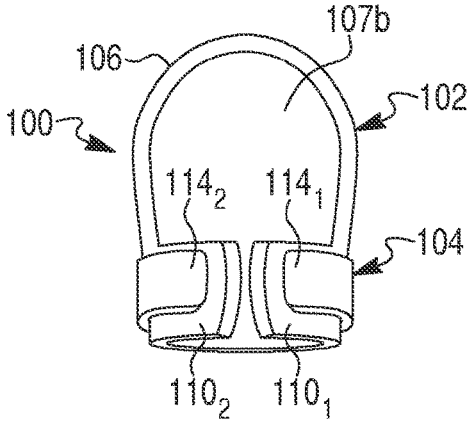
FIG. 12 is a rear side view of the protective pad assembly in accordance with the first exemplary embodiment of the present invention.
Figure 13:
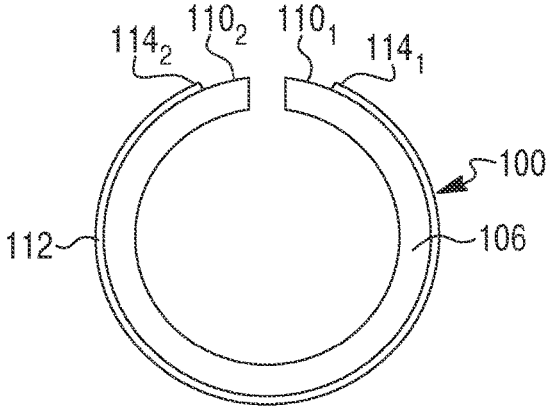
FIG. 13 is a bottom view of the protective pad assembly in accordance with the first exemplary embodiment of the present invention.

The self-retaining device 104 includes a circular self-retaining split-ring (or resilient (i.e., elastic) retaining split-ring) clamp 112 made of a resilient material. According to the first exemplary embodiment, the resilient self-retaining split-ring clamp 112 is made from any formable resilient material including plastics such as ABS or PVC, composites, spring steel, resilient wood or the like. The resilient self-retaining split-ring clamp 112 has a rectangular cross-section and has an inner surface $\mathbf{113}_1$ and an outer surface 1132, as best shown in FIG. 8. Furthermore, the resilient self-retaining split-ring clamp 112 has two opposite free ends (or split portions) $\mathbf{114}_1$ and $\mathbf{114}_2$ spaced from one another so as to define a gap therebetween and spreadable relative to one another, as best shown in FIGS. 8-10. Moreover, the free ends $\mathbf{114}_1$ and $\mathbf{114}_2$ of the resilient retaining split-ring clamp 112 are circumferentially expandable or contractable for securing (retaining) the outer protective unit 102 over an arm or a leg of the user of the protective pad assembly 100. The resilient retaining split-ring clamp 112 has a modulus of elasticity sufficient to clamp the protective cushion pad 106 of the outer protective unit 102 around the arm or leg 6 of the user to retain the protective cushion pad 106 onto the arm or leg 6 of the user over one of the elbow and the knee 7 thereof. Thus, the resilient retaining split-ring clamp 112 is able to position and maintain (or support) the protective cushion pad 106 on to the knee 7 or elbow of the user without the use of straps, elastic bands, magnets, etc., i.e., without any further support. In other words, the self-retaining device 104 is configured to maintain the outer protective unit 102 on the user's knee 7 or elbow solely by resiliency (or a resilient force, elasticity) of the resilient retaining split-ring clamp 112. The resilient retaining split-ring clamp 112 is mounted over the flexible pad 106 and attaches to the front and sides of the leg 6, and does not wrap around the back of the leg. Furthermore, the thickness of the foam cushion pad 106 is the only material that rests against the skin or pants and the tension from the resilient self-retaining device 104 is sufficient enough to keep the cushion pad 106 on the leg 6 comfortably and without causing strangulation of blood vessels, and irritation of the skin as with straps.

The resilient retaining split-ring clamp 112 of the removable self-retaining device 104 resembles a spring clamp that is rigid but flexible. The inherent spectrum of preloaded tensions of the resilient self-retaining split-ring clamp 112 of the self-retaining device 104 provides automatic pressure adjustments. Depending on the inherent characteristics of the material of the split-ring clamp 112, a predetermined spectrum of preloaded tensions can be fabricated. The preloaded tensions of the resilient split-ring clamp 112 may be increased or decreased (i.e., adjusted, modified) by making adjustments to the thickness, height, and/or diameter of the resilient material of the resilient retaining split-ring clamp 112.

The resilient split-ring clamp 112 is removably mountable (attachable) to the protective cushion pad 106 by manually opening or spreading of the free ends $\mathbf{114}_1$ and $\mathbf{114}_2$ of the resilient retaining split-ring clamp 112, as shown in FIG. 10, placing the resilient split-ring clamp 112 over the protective cushion pad 106 so that the free ends $\mathbf{114}_1$ and $\mathbf{114}_2$ of the resilient retaining split-ring clamp 112 are positioned over the side cushion members $\mathbf{110}_1$ and $\mathbf{110}_2$ thereof, respectively, and then releasing the free ends $\mathbf{114}_1$ and $\mathbf{114}_2$ of the resilient retaining split-ring clamp 112 of the self-retaining device 104 to the side cushion members $\mathbf{110}_1$ and $\mathbf{110}_2$ of the protective cushion pad 106, respectively, to form the protective pad assembly 100, as shown in FIGS. 5A, 5B and 10-14. In this way, the inner surface $\mathbf{113}_1$ of the resilient self-retaining split-ring clamp 112 engages the outer surface 107*a* of the protective cushion pad 106.

Figure 14:
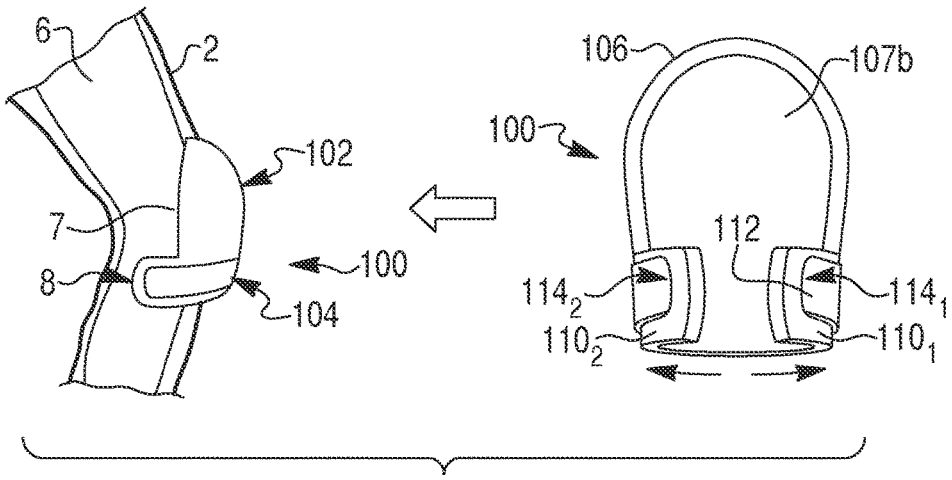
FIG. 14 shows steps of a process of mounting the protective pad assembly in accordance with the first exemplary embodiment of the present invention to the leg of the user wearing pants.

The protective pad assembly 100 is attached to a lower leg area 8 of the leg 6 of the user (wearer) below and adjacent to the knee 7 as shown in FIGS. 5A and 14. The protective pad assembly 100 is attachable to the user (wearer) by manually pulling open or spreading apart the free ends $\mathbf{114}_1$ and $\mathbf{114}_2$ of the resilient retaining split-ring clamp 112 of the self-retaining device 104 and the two side cushion members $\mathbf{110}_1$ and $\mathbf{110}_2$ of the protective cushion pad 106 simultaneously, shown in FIG. 10, then releasing the free ends $\mathbf{114}_1$ and $\mathbf{114}_2$ of the resilient retaining split-ring clamp 112 of the self-retaining device 104 and the side cushion members $\mathbf{110}_1$ and $\mathbf{110}_2$ of the protective cushion pad 106 at the lower leg area 8 below the knee 7, as best shown in FIGS. 5A and 14.

The protective pad assembly 100 may be removed from the leg 6 by pulling open or spreading the free ends $\mathbf{114}_1$ and $\mathbf{114}_2$ of the resilient retaining ring 112 of the self-retaining device 104 and the side cushion members $\mathbf{110}_1$ and $\mathbf{110}_2$ of the protective cushion pad 106 simultaneously, and then separating and detaching the protective pad assembly 100 from the leg 6 of the user (wearer). Similarly, the protective pad assembly 100 can be attached to the leg 6 of a user wearing shorts 3, as best shown in FIG. 5B, and detached therefrom in the exact manner as previously described for the user wearing pants 2. However, in this case, the protective pad assembly 100 is mountable to the skin of the user (wearer) at the knee 7 and the lower leg area 8, as shown in FIG. 5B.

The protective pad assembly 100 is held in place at the knee 7 and the lower leg area 8 solely by the resilient split-ring clamp 112 of the self-retaining device 104 applying an elastic force and grabbing the leg 6 of the user, so as to clamp the outer protective unit 102 to the leg 6 of the user at the lower leg area 8 adjacent to the knee 7 thereof. The outer protective unit 102 when combined with the self-retaining device 104 completes the protective pad assembly 100, and provides an inherent spectrum of automatic pressure adjustments so that the self-retaining device 104 enables the protective pad assembly 100 to adjust automatically to different size limbs (the arm or the leg 6 of the user) and maintain sufficient tension to stay on the limb of the user (wearer). For example, the protective pad assembly 100 can adjust automatically to multiple calf sizes of the leg accommodating 12.5" calves and larger sizes up to 17" calves whereas one (1) size fits all. FIGS. 5A and 14 show the protective pad assembly 100 attached at the knee 7 and the lower leg area 8 and attached to the leg 6 without the use of straps, elastic bands, etc., which are common for a typical protective pad assembly, which cut and pinch the user (wearer) behind the knee 7 and back of the lower leg area 8 of the leg 6 and result in irritation to the skin and limb tingling and bruising, which is brought on by constriction of the blood vessels.

Figure 15:
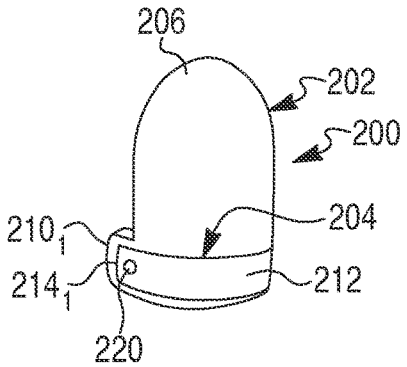
FIG. 15 is a perspective view of a protective pad assembly in accordance with a second exemplary embodiment of the present invention.
Figure 98:
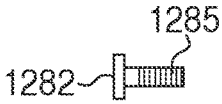
FIG. 98 shows a thumb screw of the manual override adjuster in accordance with the twelfth exemplary embodiment of the present invention.

Various modifications, changes, and alterations may be practiced with the above-described embodiment, including but not limited to the additional embodiments shown in FIGS. 15-98. In the interest of brevity, reference characters in FIGS. 15-98 that are discussed above in connection with the first exemplary embodiment of in FIGS. 5-14 are not further elaborated upon below, except to the extent necessary or useful to explain the additional embodiments of FIGS. 15-98. Modified components and parts are indicated by the addition of a hundred digits to the reference numerals of the components or parts.

Figure 16:
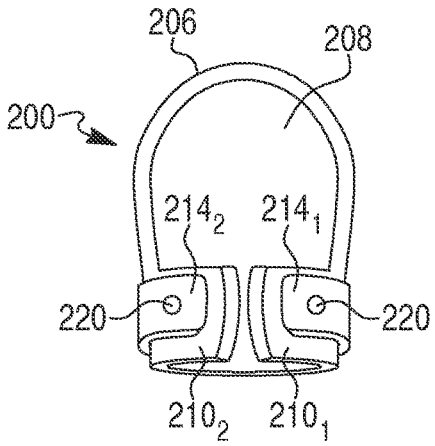
FIG. 16 is a rear side view of the protective pad assembly in accordance with the second exemplary embodiment of the present invention.
Figure 17:
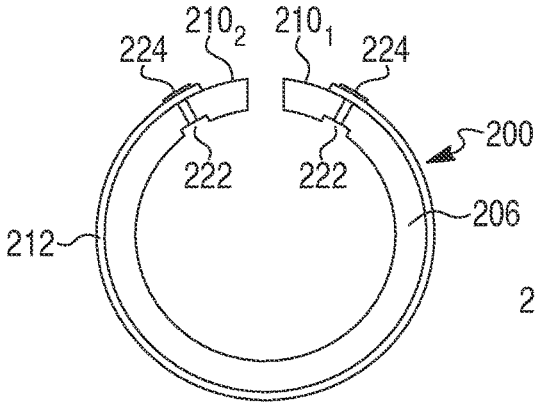
FIG. 17 is a bottom view of the protective pad assembly in accordance with the second exemplary embodiment of the present invention.
Figure 18:
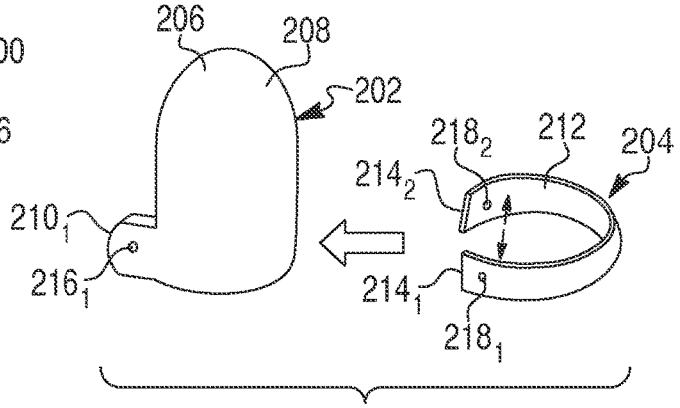
FIG. 18 shows steps of a process of mounting a self-retaining device to an outer protective unit to form the protective pad assembly in accordance with the second exemplary embodiment of the present invention.
Figure 19A:
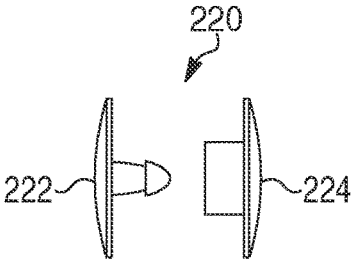
FIG. 19A is an exploded view of a snap fastener used in the protective pad assembly in accordance with the second exemplary embodiment of the present invention.
Figure 19B:
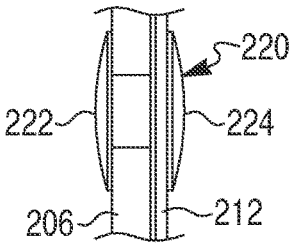
FIG. 19B shows the snap fastener used in the protective pad assembly in accordance with the second exemplary embodiment of the present invention.
Figure 20:
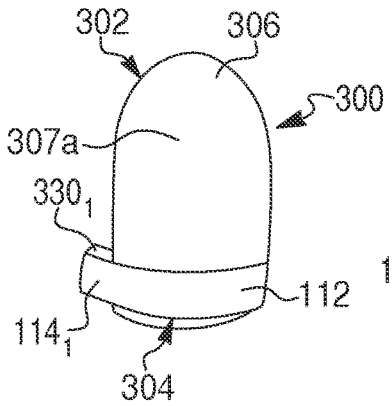
FIG. 20 is a perspective view of a protective pad assembly in accordance with a third exemplary embodiment of the present invention.
Figure 21:
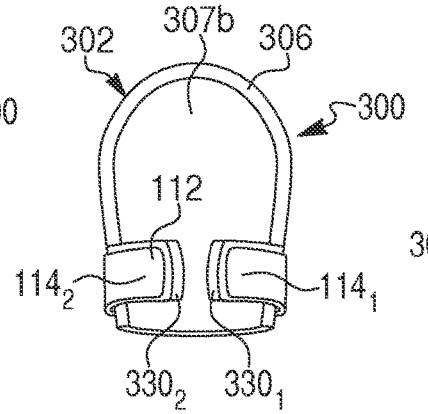
FIG. 21 is a rear side perspective view of the protective pad assembly in accordance with the third exemplary embodiment of the present invention.

A protective pad assembly 200 according to a second exemplary embodiment is illustrated in FIGS. 15-19B. The protective pad assembly 200 comprises an outer protective unit 202 configured to protect the elbow or the knee of the user from impact, and a self-adjustable, self-retaining device 204 secured to the outer protective unit 202. The outer protective unit 202 includes a flexible (or elastic, resilient) protective cushion pad 206 preferably fabricated from EVA material, while the self-retaining device 204 includes a circular self-retaining split-ring (or resilient retaining split-ring) clamp 212 made of a resilient material. According to a second exemplary embodiment, the resilient retaining split-ring clamp 212 is non-removably (i.e., permanently) attached to the protective cushion pad 206, as shown in FIGS. 15-17, by utilizing a set of fasteners 220, such as snap fasteners, as best shown in FIGS. 19A, 19B. The protective cushion pad 206 is formed with a pair of through holes $\mathbf{216}_1$ and $\mathbf{216}_2$ each formed in one of side cushion members (or portions) $\mathbf{210}_1$ and $\mathbf{210}_2$ of the protective cushion pad 206, respectively. Similarly, the resilient retaining split-ring clamp 212 is formed with a pair of through holes $\mathbf{218}_1$ and $\mathbf{218}_2$ complementary to the through holes $\mathbf{216}_1$ and $\mathbf{216}_2$ through the protective cushion pad 206. Each of the through holes $\mathbf{218}_1$ and $\mathbf{218}_2$ is formed on one of free ends 2141 and 2142 of the resilient retaining split-ring clamp 212, respectively.

As shown in FIGS. 15-17, each of the snap fasteners 220 attaches one of the free ends 2141 and 2142 of the resilient retaining split-ring clamp 212 to one of the side cushion portions $\mathbf{210}_1$ and $\mathbf{210}_2$ of the protective cushion pad 206, respectively. Moreover, each of the snap fasteners 220 includes a male part 222 and a female part 224 configured to snap together. The male parts 222 of the snap fasteners 220 are configured to extend through the through holes $\mathbf{216}_1$ and $\mathbf{216}_2$ in the protective cushion pad 206, and the complementary through holes $\mathbf{218}_1$ and $\mathbf{218}_2$ in the retaining split-ring clamp 212 to join the protective cushion pad 206 and the retaining split-ring clamp 212, as best shown in FIGS. 15-17. It shall be appreciated that alternative methods of permanent attachment of the resilient retaining split-ring clamp 212 to the protective cushion pad 206, such as adhesive bonding and other mechanical fasteners (e.g., rivets, bolts- and nuts, etc.) are within the scope of the present invention.

As illustrated in FIG. 18, the resilient split-ring clamp 212 is non-removably attached (secured) to the protective cushion pad 206 so as to form the protective pad assembly 200 by manually opening or spreading of the free ends 2141 and 2142 of the resilient retaining split-ring clamp 212, placing the resilient split-ring clamp 212 over an outer surface 207*a* of the protective cushion pad 206 so that the free ends 2141 and 2142 of the resilient retaining split-ring clamp 212 are positioned over the side cushion portions $\mathbf{210}_1$ and $\mathbf{210}_2$ thereof, respectively, so that the through holes $\mathbf{218}_1$ and $\mathbf{218}_2$ in the retaining split-ring clamp 212 are aligned (or registered) with the through holes $\mathbf{216}_1$ and $\mathbf{216}_2$ in the protective cushion pad 206, releasing the free ends 2141 and 2142 of the resilient retaining split-ring clamp 212 to the side cushion portions $\mathbf{210}_1$ and $\mathbf{210}_2$ of the protective cushion pad 206, respectively. Next, the male parts 222 of the snap fasteners 220 are inserted into the aligned through holes $\mathbf{216}_1$, $\mathbf{218}_1$ and $\mathbf{216}_2$, $\mathbf{218}_2$ in the retaining split-ring clamp 212 and the protective cushion pad 206. Then, the female parts 224 of the snap fasteners 220 are pressed over (snaped with) the male parts 222 of the snap fasteners 220 to non-removably join the resilient split-ring clamp 212 and the protective cushion pad 206 and, thus, form the protective pad assembly 200, as shown in FIGS. 15-17.

In a protective pad assembly 300 of a third exemplary embodiment illustrated in FIGS. 20-26, the outer protective unit 102 is replaced by an outer protective unit 302, and the self-retaining device 104 is replaced by a self-retaining device 304. The outer protective unit 302 of FIGS. 20-26 corresponds substantially to the outer protective unit 102 of FIGS. 5A-14, while the self-retaining device 304 corresponds substantially to the self-retaining device 104 of FIGS. 5A-14, and only the portions of the outer protective unit 302 and the self-retaining device 304, which differ, will therefore be explained in detail below.

Figure 22:
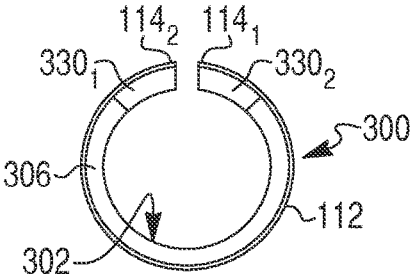
FIG. 22 is a bottom view of the protective pad assembly in accordance with the third exemplary embodiment of the present invention.
Figure 23:
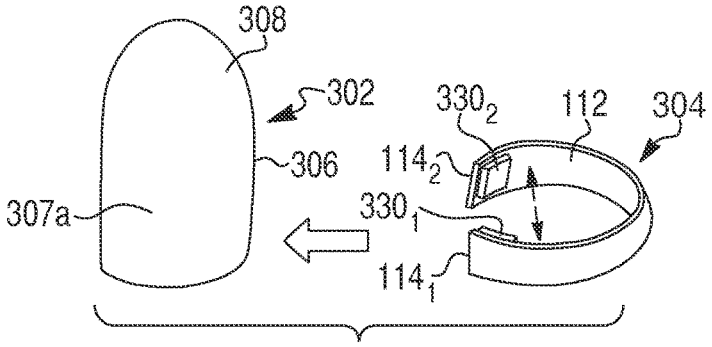
FIG. 23 shows steps of a process of mounting a self-retaining device to an outer protective unit to form the protective pad assembly in accordance with the third exemplary embodiment of the present invention.
Figure 24:
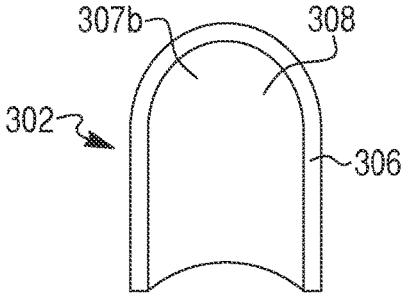
FIG. 24 is a rear perspective view of the outer protective unit in accordance with the third exemplary embodiment of the present invention.
Figure 25:
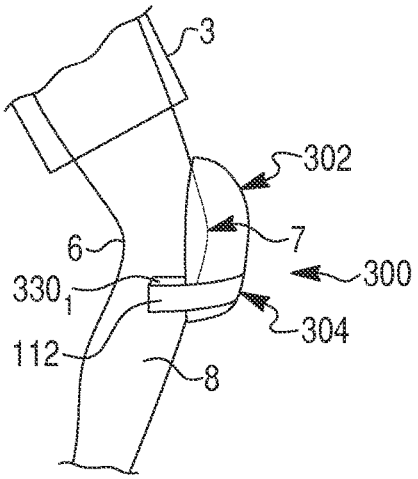
FIG. 25 shows the protective pad assembly in accordance with the third exemplary embodiment of the present invention mounted to the leg of the user wearing shorts.
Figure 26:
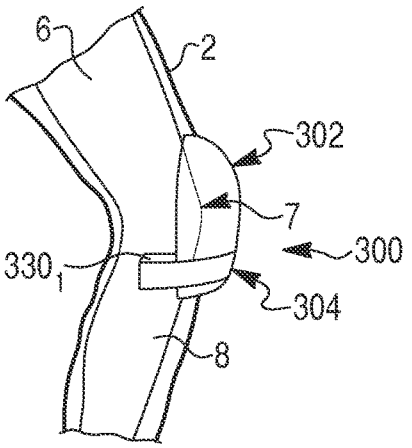
FIG. 26 shows the protective pad assembly in accordance with the third exemplary embodiment of the present invention mounted to the leg of the user wearing pants.
Figure 27:
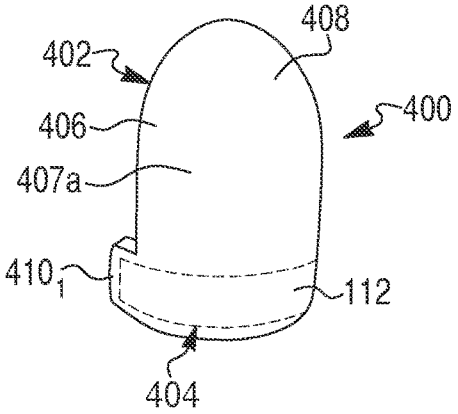
FIG. 27 is a right-side perspective view of a protective pad assembly in accordance with a fourth exemplary embodiment of the present invention.
Figure 28:
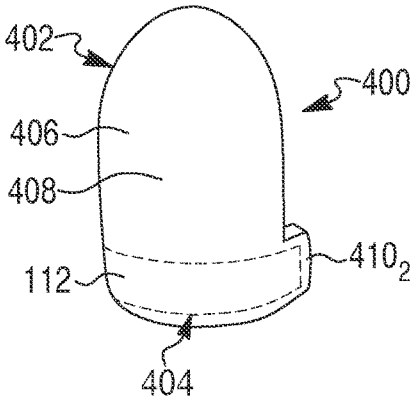
FIG. 28 is a left-side perspective view of the protective pad assembly in accordance with the fourth exemplary embodiment of the present invention.

The protective pad assembly 300 comprises the outer protective unit 302 configured to protect the elbow or the knee of the user from impact, and the self-retaining device 304 removably mounted to the outer protective unit 302, as best shown in FIGS. 20-26. According to the third exemplary embodiment, the outer protective unit 302 includes a flexible (or elastic, resilient) protective cushion pad 306, preferably fabric fabricated from EVA. As best shown in FIGS. 22, 25 and 26, the protective cushion pad 306 has a concave body 308 and, unlike the protective cushion pad 106 of the first exemplary embodiment, does not have two (2) side cushion portions outwardly extending from opposite sides of the concave body 308, such as the side cushion portions $\mathbf{110}_1$ and $\mathbf{110}_2$ of the outer protective unit 102 of the first exemplary embodiment best shown in FIGS. 6 and 7. The protective cushion pad 306 has an outer surface 307*a* and an inner surface 307*b*, as best shown in FIGS. 23 and 24.

The self-retaining device 304 includes the circular self-retaining split-ring (or resilient (i.e., elastic) retaining split-ring) clamp 112 having opposite free ends (or split portions) $\mathbf{114}_1$ and $\mathbf{114}_2$ spaced from one another and spreadable relative to one another. Each of the free ends $\mathbf{114}_1$ and $\mathbf{114}_2$ of the retaining split-ring clamp 112 of the self-retaining device 304 is provided with a flexible cushion pad $\mathbf{330}_1$ and $\mathbf{330}_2$, respectively, secured to the inner surface $\mathbf{113}_1$ of the resilient self-retaining split-ring clamp 112, as best shown in FIGS. 20-23, 25 and 26. The flexible cushion pads $\mathbf{330}_1$ and $\mathbf{330}_2$ can be attached to the free ends $\mathbf{114}_1$ and $\mathbf{114}_2$ of the retaining split-ring clamp 112 by adhesive bonding, hot glue and/or fastened by snap fasteners and other mechanical fasteners such as rivets, screws, nuts and bolts. The removable self-retaining device 304 works like a spring clamp that is rigid but flexible. The removable self-retaining device 304 has an inherent spectrum of preloaded tensions that provides automatic pressure adjustments. Depending on the characteristics and dimensions of the material utilized for manufacturing the retaining split-ring clamp 112, the self-retaining device 304 with a predetermined spectrum of tensions can be fabricated relatively inexpensively.

The removable self-retaining device 304 with the flexible cushion pads $\mathbf{330}_1$ and $\mathbf{330}_2$ is removably mountable (attachable) to the protective cushion pad 306 by manually opening or spreading the free ends $\mathbf{114}_1$ and $\mathbf{114}_2$ of the resilient retaining split-ring clamp 112, as shown in FIG. 23, placing the resilient split-ring clamp 112 over the protective cushion pad 306 so that the free ends $\mathbf{114}_1$ and $\mathbf{114}_2$ of the resilient retaining split-ring clamp 112 and the flexible cushion pads $\mathbf{330}_1$ and $\mathbf{330}_2$ are positioned outside the concave body 308 of the protective cushion pad 306, then releasing the free ends $\mathbf{114}_1$ and $\mathbf{114}_2$ of the resilient retaining split-ring clamp 112 of the self-retaining device 304 so that the inner surface $\mathbf{113}_1$ of the resilient self-retaining split-ring clamp 112 engages of an outer surface 307*a* of the protective cushion pad 306 to form the protective pad assembly 300, as shown in FIGS. 20-22 and 25, 26.

The protective pad assembly 300 can be attached to the leg 6 of the user (wearer) wearing pants 2 at the knee 7 and lower leg area 8 as shown in FIG. 26. The protective pad assembly 300 is mountable to the leg 6 of the user (wearer) by manually pulling open or spreading of the free ends $\mathbf{114}_1$ and $\mathbf{114}_2$ of the resilient retaining ring 112 with the incorporated cushion pads $\mathbf{330}_1$ and $\mathbf{330}_2$, then, releasing the free ends $\mathbf{114}_1$ and $\mathbf{114}_2$ of the resilient retaining ring 112 at the knee 7 and lower leg area 8 as shown in FIG. 24. The protective pad assembly 300 may be removed from the leg 6 by pulling open or spreading of the free ends $\mathbf{114}_1$ and $\mathbf{114}_2$ of the resilient retaining ring 112 of the self-retaining device 304 simultaneously, then separating and detaching the protective pad assembly 300 from the leg 6 of the user (wearer). Similarly, the protective pad assembly 300 can be attached to the leg 6 of the user wearing shorts 3, as best shown in FIG. 25, and detached therefrom in the exact manner as previously described for the user wearing pants 2. However, in this case the protective pad assembly 300 is mountable to the skin of the user (wearer) at the knee 7 and the lower leg area 8, as shown in FIG. 25.

It shall be appreciated that the protective pad assembly 300 is held in place at the knee 7 and the lower leg area 8 solely by the resilient split-ring clamp 112 of the self-retaining device 304 applying an inherent elastic force and grabbing the leg 6 of the user, so as to clamp the outer protective unit 302 to the leg 6 of the user at the lower leg area 8 adjacent to the knee 7 thereof. It shall be further appreciated that the self-retaining device 304, when combined with the outer protective unit 302, completes the protective pad assembly 300, and provides an inherent spectrum of automatic pressure adjustments which enables the self-retaining device 304 of the protective pad assembly 300 to adjust automatically to different size limbs and maintain sufficient tension to stay on the user (wearer).

In a protective pad assembly 400 of a fourth exemplary embodiment illustrated in FIGS. 27-33, the outer protective unit 102 of the first exemplary embodiment is replaced by an outer protective unit 402. The outer protective unit 402 of FIGS. 27-33 corresponds substantially to the outer protective unit 102 of FIGS. 5A-14, and only the portions of the outer protective unit 402, which differ, will therefore be explained in detail below.

Figure 29:
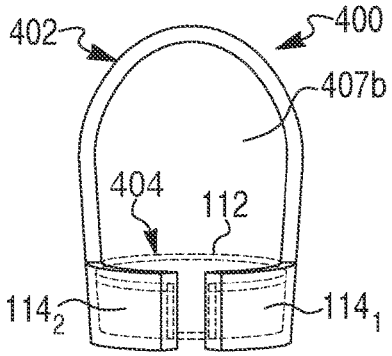
FIG. 29 is a rear-side perspective view of the protective pad assembly in accordance with the fourth exemplary embodiment of the present invention.
Figure 30:
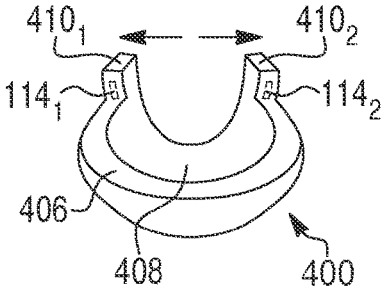
FIG. 30 is a top perspective view from the front of the protective pad assembly in accordance with the fourth exemplary embodiment of the present invention.
Figure 31:
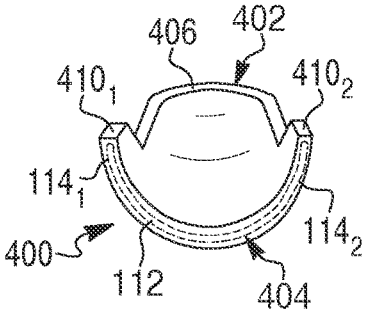
FIG. 31 is a top perspective view from the rear of the protective pad assembly in accordance with the fourth exemplary embodiment of the present invention.

The protective pad assembly 400 comprises the outer protective unit 402 configured to protect the elbow or the knee of the user from impact, and a self-retaining device 404 non-removably mounted (or secured, attached) to the outer protective unit 402, as best shown in FIGS. 27-31. According to the fourth exemplary embodiment, the outer protective unit 402 includes a flexible (or elastic, resilient) protective cushion pad 406, preferably fabricated from EVA. The protective cushion pad 406 has a concave central cushion member (or portion) 408 and two (2) flexible side cushion members (or portions) $\mathbf{410}_1$ and $\mathbf{410}_2$ outwardly extending from opposite sides of the central cushion member 408 and formed integrally therewith, as best shown in FIGS. 27-31. The protective cushion pad 406 has an outer surface 407*a* and an inner surface 407*b*. As best shown in FIGS. 27-31, the self-retaining device 404 is non-removably mounted (or permanently secured) to the protective cushion pad 406 of the outer protective unit 402, including the central cushion member 408 and the flexible side cushion members $\mathbf{410}_1$ and $\mathbf{410}_2$. Specifically, the resilient retaining split-ring clamp 112 of the self-retaining device 404 is inserted or embedded into the central cushion member 408 and the flexible side cushion members $\mathbf{410}_1$ and $\mathbf{410}_2$ of the protective cushion pad 406 by lamination, insert molding or over-molding processes, as best shown in FIGS. 29-31. As further shown in FIGS. 29-31, the free ends $\mathbf{114}_1$ and $\mathbf{114}_2$ of the resilient retaining split-ring clamp 112 are disposed in the flexible side cushion members $\mathbf{410}_1$ and $\mathbf{410}_2$ of the protective cushion pad 406.

Figure 32:
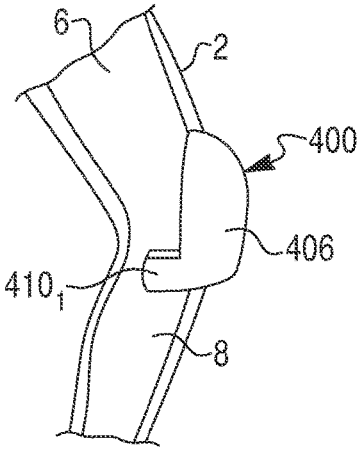
FIG. 32 shows the protective pad assembly in accordance with the fourth exemplary embodiment of the present invention mounted to a leg of a user wearing pants.
Figure 33:
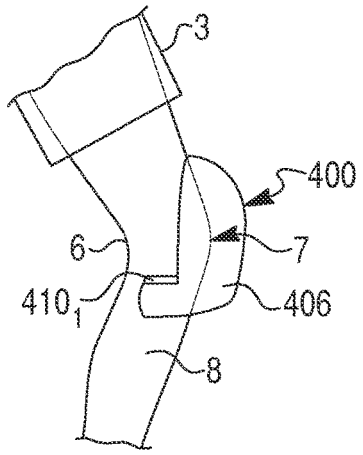
FIG. 33 shows the protective pad assembly in accordance with the fourth exemplary embodiment of the present invention mounted to the leg of the user wearing shorts.

The protective pad assembly 400 is attached to the leg 6 of the user (wearer) wearing pants 2 at the knee area 7 as shown in FIG. 32. The protective pad assembly 400 is mountable to the user (wearer) by manually pulling open or spreading the flexible side cushion portions $\mathbf{410}_1$ and $\mathbf{410}_2$ of the protective cushion pad 406, which in turn spreads apart the free ends $\mathbf{114}_1$ and $\mathbf{114}_2$ of the resilient retaining split-ring clamp 112 of the self-retaining device 404 within the protective cushion pad 406, and then releasing the flexible side cushion portions $\mathbf{410}_1$ and $\mathbf{410}_2$ of the protective cushion pad 406 at the knee 7 and lower leg area 9 of the leg 6, as shown at FIGS. 32 and 33. The protective pad assembly 400 is removable by pulling open or spreading the flexible side cushion portions $\mathbf{410}_1$ and $\mathbf{410}_2$ of the protective cushion pad 406, which in turn spreads apart the free ends $\mathbf{114}_1$ and $\mathbf{114}_2$ of the resilient retaining split-ring clamp 112 of the self-retaining device 404 within the protective cushion pad 406, and then the protective pad assembly 400 is released and detached from the leg 6 of the user (wearer). Alternately, the protective pad assembly 400 can also be attached to the leg 6 of the user wearing shorts 3, as shown in FIG. 33, and detached in the exact manner as previously described for wearing pants 2.

It shall be appreciated that the protective pad assembly 400 is held in place at the knee 7 and lower leg area 9 of the leg 6 solely by the inserted or embedded self-retaining device 404 which generates and exerts inherent forces of tension to grab the leg 6 and clamp the outer protective unit 402 to the lower leg area 8 of the leg 6. The protective pad assembly 400 has an inherent spectrum of automatic pressure adjustments provided by the inserted or embedded self-retaining device 404 that enables the protective pad assembly 400 to adjust automatically to different size limbs and maintain sufficient tension to stay on the user (wearer).

Figure 34:
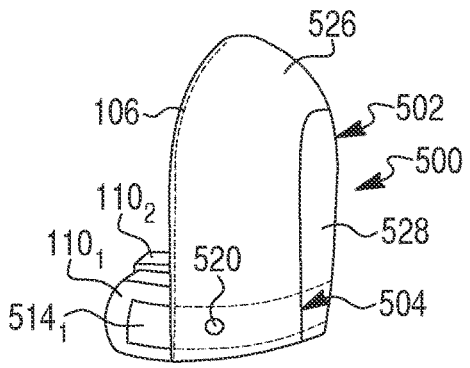
FIG. 34 is a side perspective view of a protective pad assembly in accordance with a fifth exemplary embodiment of the present invention.
Figure 35:
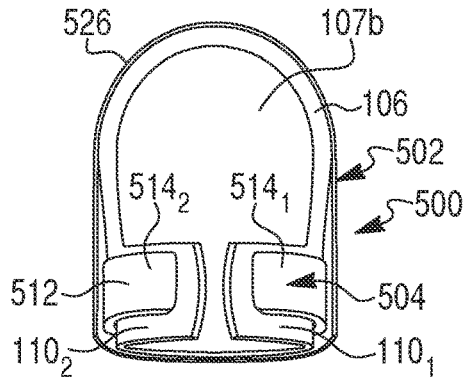
FIG. 35 is a rear perspective view of the protective pad assembly in accordance with the fifth exemplary embodiment of the present invention.
Figure 36:
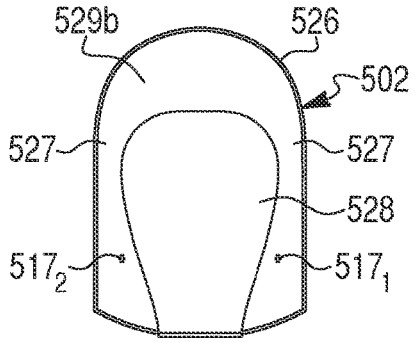
FIG. 36 is a front view of a flexible hard cap of an outer protective unit in accordance with the fifth exemplary embodiment of the present invention.
Figure 37:
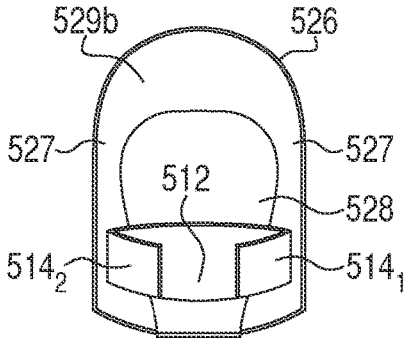
FIG. 37 is a rear perspective view of the flexible hard cap of the outer protective unit with a resilient self-retaining split-ring clamp in accordance with the fifth exemplary embodiment of the present invention.
Figure 38:
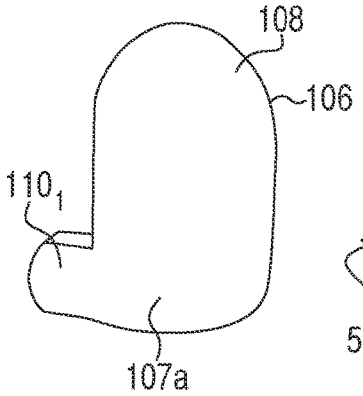
FIG. 38 is a perspective view of the protective cushion pad of the outer protective unit in accordance with the fifth exemplary embodiment of the present invention.

A protective pad assembly 500 according to a fifth exemplary embodiment is illustrated in FIGS. 34-42. The protective pad assembly 500 comprises an outer protective unit 502 configured to protect the elbow or the knee of the user from impact, and a self-adjustable, self-retaining device 504 secured to the outer protective unit 502. The outer protective unit 502 includes a flexible (or elastic, resilient) protective cushion pad 106, best shown in FIG. 38, preferably fabricated from EVA material, and a flexible hard cap 526 (best shown best in FIGS. 36-37) removably attachable to the protective cushion pad 106. The flexible hard cap 526 is a tub-shaped body having rounded upward walls 527 and a flat central bottom portion 528 as shown in FIGS. 36-37. The hard cap 526 is fabricated from a rigid EVA material, which is durable and lightweight. The flat portion 528 of the flexible hard cap 526 is used for stability when making contact with the ground or surface.

Figure 39:
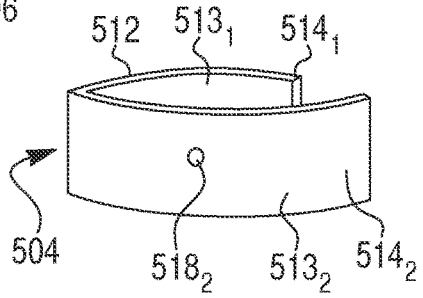
FIG. 39 is a perspective view of a resilient retaining split-ring clamp of a self-retaining device in accordance with the fifth exemplary embodiment of the present invention.
Figure 40:
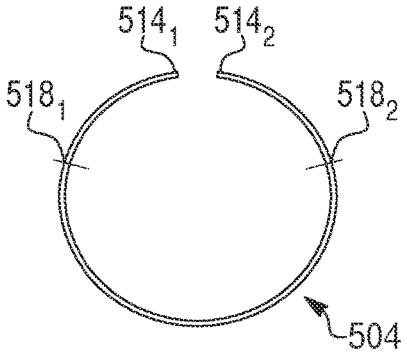
FIG. 40 is a top view of the resilient self-retaining split-ring clamp in accordance with the fifth exemplary embodiment of the present invention.

The self-retaining device 504 includes a circular self-retaining split-ring (or resilient retaining split-ring) clamp 512 made of a resilient material. The resilient self-retaining split-ring clamp 512 has two opposite free ends (or split portions) $\mathbf{514}_1$ and $\mathbf{514}_2$ spaced from one another and spreadable relative to one another, as best shown in FIGS. 39-40. Moreover, the free ends $\mathbf{514}_1$ and $\mathbf{514}_2$ of the resilient retaining split-ring clamp 512 are circumferentially expandable or contractable for securing (retaining) the outer protective unit 502 over an arm or a leg of the user of the protective pad assembly 500.

According to the fifth exemplary embodiment, the resilient retaining split-ring clamp 512 is non-removably (i.e., permanently) attached to the hard cap 526, as best shown in FIG. 34, by utilizing fastening rivets 520. The flexible hard cap 526 is formed with a pair of through holes $\mathbf{517}_1$ and $\mathbf{517}_2$ (best shown in FIG. 36), while the resilient retaining split-ring clamp 512 is formed with a pair of through holes $\mathbf{518}_1$ and $\mathbf{518}_2$ (best shown in FIGS. 39-40) complementary to the through holes $\mathbf{517}_1$ and $\mathbf{517}_2$ through the flexible hard cap 526. The rivets 520 extend through the through holes $\mathbf{517}_1$ and $\mathbf{517}_2$ in the hard cap 526 and the complementary through holes $\mathbf{518}_1$ and $\mathbf{518}_2$ in the retaining split-ring clamp 512 to join the hard cap 526 and the retaining split-ring clamp 512, as best shown in FIG. 37. It shall be appreciated that alternative methods of permanent attachment of the resilient retaining split-ring clamp 512 to the hard cap 526, such as adhesive bonding and other mechanical fasteners (e.g., snap fasteners, bolts- and nuts, etc.) are within the scope of the present invention.

As illustrated in FIG. 37, the resilient split-ring clamp 512 is non-removably attached (secured) to the hard cap 526 by placing an outer surface $\mathbf{513}_2$ of the resilient split-ring clamp 512 over and in contact with an inner surface 529*b* of the hard cap 526 so that the through holes $\mathbf{518}_1$ and $\mathbf{518}_2$ in the retaining split-ring clamp 512 are aligned (or registered) with the through holes $\mathbf{517}_1$ and $\mathbf{517}_2$ in the hard cap 526. Next, the rivets 520 are inserted into the aligned through holes $\mathbf{517}_1$, $\mathbf{518}_1$ and $\mathbf{517}_2$, $\mathbf{518}_2$ in the retaining split-ring clamp 512 and the hard cap 526, then the retaining split-ring clamp 512 and the hard cap 526 are riveted together by the rivets 520, as shown in FIGS. 34 and 37.

The resilient split-ring clamp 512 with the hard cap 526 is removably mountable (attachable) to the protective cushion pad 106 by manually opening or spreading of the free ends $\mathbf{514}_1$ and $\mathbf{514}_2$ of the resilient retaining split-ring clamp 512, as shown in FIG. 37, placing the resilient split-ring clamp 512 with the hard cap 526 over the protective cushion pad 106 so that the free ends $\mathbf{514}_1$ and $\mathbf{514}_2$ of the resilient retaining split-ring clamp 512 are positioned over the side cushion portions $\mathbf{110}_1$ and $\mathbf{110}_2$ of the protective cushion pad 106, respectively, and then releasing the free ends $\mathbf{514}_1$ and $\mathbf{514}_2$ of the resilient retaining split-ring clamp 512 of the self-retaining device 504 to the side cushion portions $\mathbf{110}_1$ and $\mathbf{110}_2$ of the protective cushion pad 106, respectively, to form the protective pad assembly 500, as shown in FIGS. 34 and 35. Accordingly, the inner surface 5131 of the resilient self-retaining split-ring clamp 512 engages the outer surface 107*a* of the protective cushion pad 106.

Figure 41:
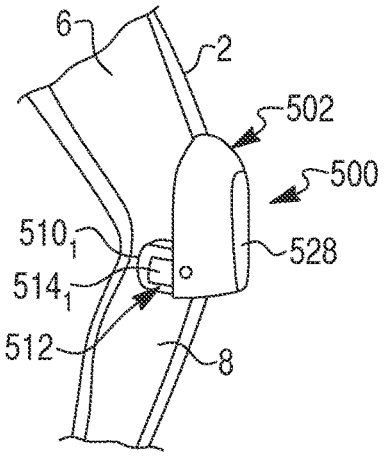
FIG. 41 shows the protective pad assembly in accordance with the fifth exemplary embodiment of the present invention mounted to a leg of a user wearing pants.
Figure 42:
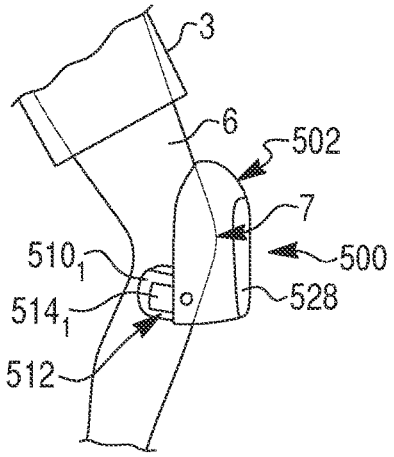
FIG. 42 shows the protective pad assembly in accordance with the fifth exemplary embodiment of the present invention mounted to the leg of the user wearing shorts.

The protective pad assembly 500 is attached to a lower leg area 8 of the leg 6 of the user (wearer) below and adjacent to the knee 7 as shown in FIGS. 41 and 42. The protective pad assembly 500 is attachable to the user (wearer) by manually pulling open or spreading apart the free ends $\mathbf{514}_1$ and $\mathbf{514}_2$ of the resilient retaining split-ring clamp 512 of the self-retaining device 504 and the t two side cushion portions $\mathbf{110}_1$ and $\mathbf{110}_2$ of the protective cushion pad 106 simultaneously, shown in FIGS. 34 and 35, and then releasing the free ends $\mathbf{514}_1$ and $\mathbf{514}_2$ of the resilient retaining split-ring clamp 512 and the side cushion portions $\mathbf{110}_1$ and $\mathbf{110}_2$ of the protective cushion pad 106 at the lower leg area 8 below the knee 7, as best shown in FIGS. 41 and 42.

The protective pad assembly 500 may be removed from the leg 6 by pulling open or spreading of the free ends $\mathbf{514}_1$ and $\mathbf{514}_2$ of the resilient retaining split-ring clamp 512 and the side cushion portions $\mathbf{110}_1$ and $\mathbf{110}_2$ of the protective cushion pad 106 simultaneously, then separating and detaching the protective pad assembly 500 from the leg 6 of the user (wearer). Similarly, the protective pad assembly 500 can be attached to the leg 6 of the user wearing shorts 3, as best shown in FIG. 42, and detached therefrom in the exact manner as previously described for the user wearing pants 2.

It shall be appreciated that the protective pad assembly 500 is held in place at the knee 7 and lower leg area 9 of the leg 6 solely by resilient retaining split-ring clamp 512 of the self-retaining device 504 which generates and exerts inherent tension sufficient to grab the leg 6 and clamp the outer protective unit 502 to the lower leg area 9 of the leg 6. The protective pad assembly 500 has an inherent spectrum of automatic pressure adjustments provided by the resilient retaining split-ring clamp 512 that enables the protective pad assembly 500 to adjust automatically to different size limbs and maintain sufficient tension to stay on the user (wearer).

Figure 44:
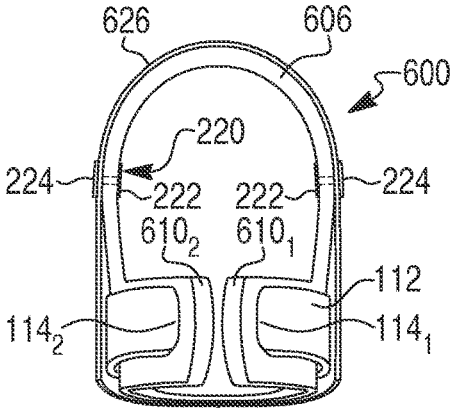
FIG. 44 is a rear perspective view of the protective pad assembly in accordance with the sixth exemplary embodiment of the present invention.
Figure 45:
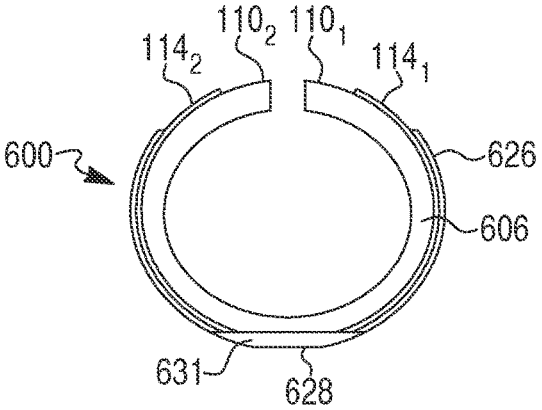
FIG. 45 is a bottom view of the protective pad assembly in accordance with the sixth exemplary embodiment of the present invention.
Figure 46:
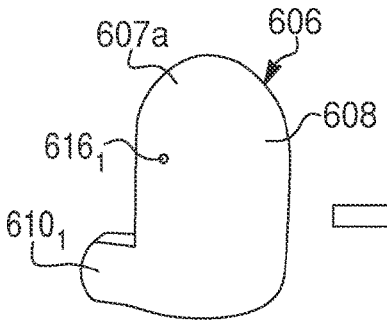
FIG. 46 is a perspective view of the protective cushion pad of the outer protective unit in accordance with the sixth exemplary embodiment of the present invention.
Figure 47:
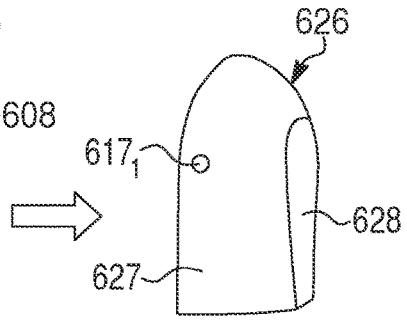
FIG. 47 is a perspective view of a flexible hard cap of the outer protective unit in accordance with the sixth exemplary embodiment of the present invention.
Figure 48:
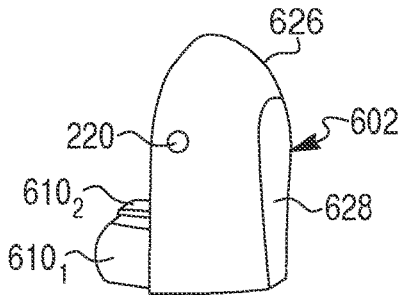
FIG. 48 is a perspective view of the outer protective unit in accordance with the sixth exemplary embodiment of the present invention.
Figure 49:
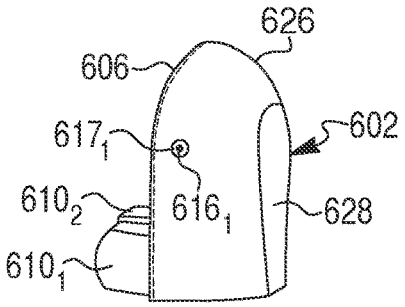
FIG. 49 is a perspective view of the outer protective unit in accordance with the sixth exemplary embodiment of the present invention, wherein the protective cushion pad and the flexible hard cap are not connected with snap fasteners.
Figure 50:
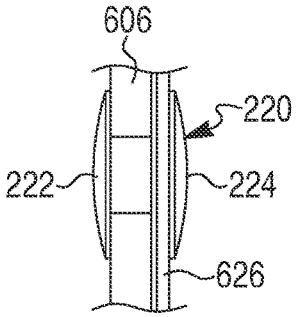
FIG. 50 shows the snap fastener used in the protective pad assembly in accordance with the sixth exemplary embodiment of the present invention.
Figure 51:
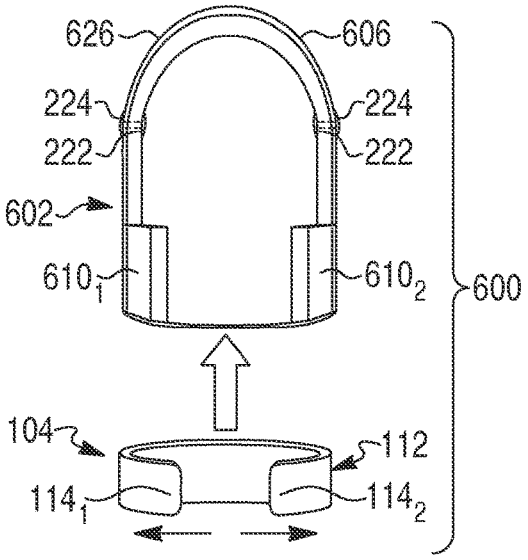
FIG. 51 shows steps of a process of mounting a self-retaining device to an outer protective unit to form the protective pad assembly in accordance with the sixth exemplary embodiment of the present invention.
Figure 52:
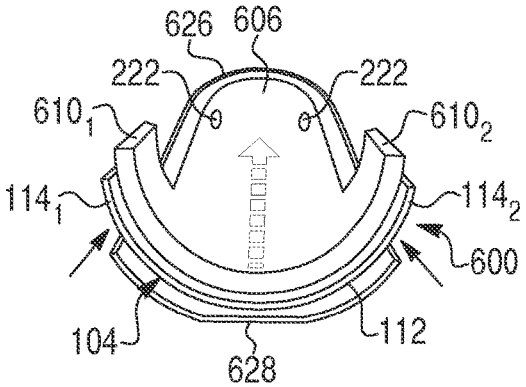
FIG. 52 is a top perspective view of the outer protective unit in accordance with the sixth exemplary embodiment of the present invention.

A protective pad assembly 600 according to a sixth exemplary embodiment is illustrated in FIGS. 43-53B. The protective pad assembly 600 comprises an outer protective unit 602 configured to protect the elbow or the knee of the user from impact, and a self-adjustable, self-retaining device 104 mounted to the outer protective unit 602. The outer protective unit 602 includes a flexible (or elastic, resilient) protective cushion pad 606, preferably fabricated from EVA material, and a flexible hard cap 626 (best shown best in FIGS. 44-45, 47 and 50) non-removably attached to the protective cushion pad 606. As best shown in FIGS. 46, 51 and 52, the protective cushion pad 606 is similar to the protective cushion pad 106 and has a central cushion member (or portion) 608 and two (2) flexible side cushion members (or portions) $\mathbf{610}_1$ and $\mathbf{610}_2$ outwardly extending from opposite sides of the central cushion member 608 and formed integrally therewith. The flexible hard cap 626 is a tub-shaped body having rounded upward walls 627 and a flat central bottom portion 628, as best shown in FIGS. 47 and 50. The flat portion 628 of the flexible hard cap 626 provides stability when making contact with the ground or surface. A raised back stop portion 631 used to contain the end of the flexible protective cushion pad 606. The hard cap 626 is fabricated from a rigid EVA material, which is durable and lightweight.

The protective cushion pad 606 is formed with a pair of through holes $\mathbf{616}_1$ and $\mathbf{616}_2$, each formed in the central cushion portion 608 thereof, while the flexible hard cap 626 is formed with a pair of through holes $\mathbf{617}_1$ and $\mathbf{617}_2$ complementary to the through holes $\mathbf{616}_1$ and $\mathbf{616}_2$ through the protective cushion pad 606, as best shown in FIGS. 46 and 47. The hard cap 626 is non-removably (i.e., permanently) attached to an outer surface 607*a* of the protective cushion pad 606, as best shown in FIG. 47, by utilizing snap fasteners 220, so as to form the outer protective unit 602. The male parts 222 of the snap fasteners 220 extend through the through holes $\mathbf{616}_1$ and $\mathbf{616}_2$ in the protective cushion pad 606, and the complementary through holes $\mathbf{617}_1$ and $\mathbf{617}_2$ in the hard cap 626, to join the protective cushion pad 606 and the hard cap 626 together, as best shown in FIGS. 43-45 and 50. It shall be appreciated that alternative methods of permanent attachment of the hard cap 626 to the protective cushion pad 606, such as adhesive bonding and other mechanical fasteners (e.g., rivets, bolts- and nuts, etc.) are within the scope of the present invention. The male parts 222 and the female parts 224 of the snap fasteners 220 snap together to join the material of the protective cushion pad 606 and the hard cap 626 between them, with the male parts 222 affixed from the protective cushion pad 606 and the female parts 224 of the snap fasteners 220 affixed from the hard cap 626 as best shown in FIG. 49. With the snap fasteners 220 installed, the protective cushion pad 606 and the hard cap 626 become a permanent unit and form the outer protective unit 602 as shown in FIGS. 52 and 51.

Figure 43:
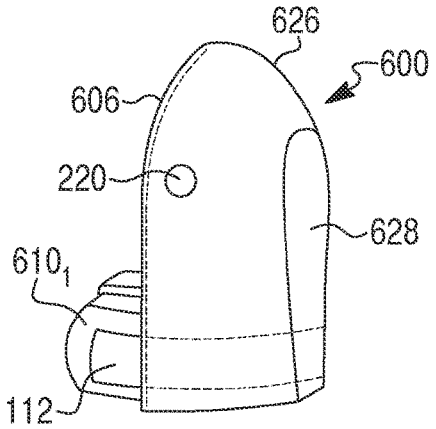
FIG. 43 is a side perspective view of a protective pad assembly in accordance with a sixth exemplary embodiment of the present invention.

The outer protective unit 602 is removably connectable to the resilient retaining split-ring clamp 112 of the self-retaining device 104 to assemble the protective pad assembly 600 of the sixth embodiment. Specifically, the resilient split-ring clamp 112 is removably mountable (attachable) to the outer protective unit 602 by manually opening or spreading the free ends $\mathbf{114}_1$ and $\mathbf{114}_2$ of the resilient retaining split-ring clamp 112, as shown in FIG. 51, placing the resilient split-ring clamp 112 around the protective cushion pad 606 and the hard cap 626 so that the free ends $\mathbf{114}_1$ and $\mathbf{114}_2$ of the resilient retaining split-ring clamp 112 are positioned over the side cushion portions $\mathbf{610}_1$ and $\mathbf{610}_2$ thereof, respectively, and then releasing the free ends $\mathbf{114}_1$ and $\mathbf{114}_2$ of the resilient retaining split-ring clamp 112 of the self-retaining device 104 to the side cushion portions $\mathbf{610}_1$ and $\mathbf{610}_2$ of the protective cushion pad 606, respectively, to form the protective pad assembly 600, as shown in FIGS. 43-45. Although the protective cushion pad 606 and the hard cap 626 are formed as a unit, it shall be understood that the bottom (or base) 603 of the outer protective unit 602 inherently has enough flexibility such that one can separate the protective cushion pad 606 from the flexible hard cap 626, which allows placement of the resilient retaining split-ring clamp 112 in the space between the protective cushion pad 606 and the hard cap 626, as illustrated in FIGS. 44 and 51.

Figure 53A:
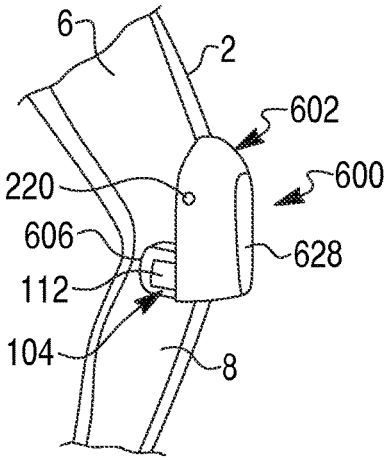
FIG. 53A shows the protective pad assembly in accordance with the sixth exemplary embodiment of the present invention mounted to a leg of a user wearing pants.
Figure 53B:
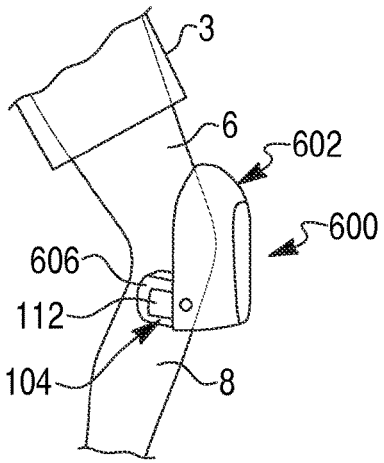
FIG. 53B shows the protective pad assembly in accordance with the sixth exemplary embodiment of the present invention mounted to the leg of the user wearing shorts.

The protective pad assembly 600 is attached to a lower leg area 8 of the leg 6 of the user (wearer) below and adjacent to the knee 7 as shown in FIGS. 53A and 53B. The protective pad assembly 600 is attachable to the user (wearer) by manually pulling open or spreading apart the free ends $\mathbf{114}_1$ and $\mathbf{114}_2$ of the resilient retaining split-ring clamp 112 of the self-retaining device 104 and the two side cushion portions $\mathbf{610}_1$ and $\mathbf{610}_2$ of the protective cushion pad 606 simultaneously, shown in FIG. 52, and then releasing the free ends $\mathbf{114}_1$ and $\mathbf{114}_2$ of the resilient retaining split-ring clamp 112 and the side cushion portions $\mathbf{610}_1$ and $\mathbf{610}_2$ of the protective cushion pad 606 at the lower leg area 8 below the knee 7, as best shown in FIG. 53A or 53B. The protective pad assembly 600 may be removed from the leg 6 by pulling open or spreading of the free ends $\mathbf{114}_1$ and $\mathbf{114}_2$ of the resilient retaining split-ring clamp 112 and the side cushion portions $\mathbf{610}_1$ and $\mathbf{610}_2$ of the protective cushion pad 606 simultaneously, then separating and detaching the protective pad assembly 600 from the leg 6 of the user (wearer). Similarly, the protective pad assembly 600 can be attached to the leg 6 of the user wearing shorts 3, as best shown in FIG. 53B, and detached therefrom in the exact manner as previously described for the user wearing pants 2.

It shall be appreciated that the protective pad assembly 600 is held in place at the knee 7 and lower leg area 9 of the leg 6 solely by resilient retaining split-ring clamp 112 of the self-retaining device 104 which generates and exerts tension sufficient to grab the leg 6 and clamp the outer protective unit 602 to the lower leg area 9 of the leg 6. The protective pad assembly 600 has an inherent spectrum of automatic pressure adjustments provided by the resilient retaining split-ring clamp 112 that enables the protective pad assembly 600 to adjust automatically to different size limbs and maintain sufficient tension to stay on the user (wearer).

The protective pad assembly 600 is attached to the leg 6 of the user (wearer) wearing pants 2 at the knee area 7 and the lower leg area 9 of the leg 6 as shown in FIGS. 53A. Alternately, the protective pad assembly 600 can also be attached to the leg 6 of the user wearing shorts 3 (shown in FIG. 53B), and detached in the exact manner as previously described for wearing pants.

Figure 54:
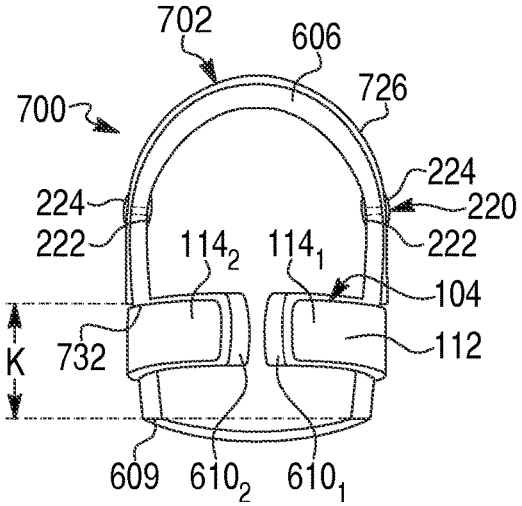
FIG. 54 is a rear perspective view of the protective pad assembly in accordance with a seventh exemplary embodiment of the present invention.

A protective pad assembly 700 according to a seventh exemplary embodiment is illustrated in FIGS. 54-60B. The protective pad assembly 700 comprises an outer protective unit 702 configured to protect the elbow or the knee of the user from impact, and a self-adjustable, self-retaining device 104 mounted to the outer protective unit 702. The outer protective unit 702 includes a flexible (or elastic, resilient) protective cushion pad 606, preferably fabricated from EVA material, and a flexible short hard cap 726 non-removably attached to the protective cushion pad 606. As best shown in FIGS. 46, and 56, the protective cushion pad 606 has a central cushion portion 608 and two (2) flexible side cushion portions $\mathbf{610}_1$ and $\mathbf{610}_2$ outwardly extending from opposite sides of the central cushion portion 608 and formed integrally therewith. The short hard cap 726 is shorter than the protective cushion pad 606 (as shown in FIGS. 54 and 57-59) and has a tub-shaped body with a flat central bottom portion 728, as best shown in FIGS. 56-59. The hard cap 726 is shorter than the protective cushion pad 606 by a distance K (shown in FIG. 54), which is the distance between a bottom portion 609 of the protective cushion pad 606 and a bottom portion 732 of the short hard cap 726, as best shown in FIG. 54. As further illustrated in FIGS. 54 and 57-59, the resilient split-ring clamp 112 is mounted to the protective cushion pad 606 only below the short hard cap 726. The short hard cap 726 is approximately two-thirds (⅔) of height of the protective cushion pad 606 and is approximately 40% lighter in weight as compared to the full size hard caps 526 and 626 of the fifth and sixth exemplary embodiments. The flat bottom portion 728 of the flexible hard cap 726 provides stability when making contact with the ground or surface. The hard cap 726 is fabricated from a rigid EVA material, which is durable and lightweight. The short hard cap 726 secured to the longer protective cushion pad 606 provides more torsional and/or twist motion for the user.

The short hard cap 726 is formed with a pair of through holes $\mathbf{717}_1$ and $\mathbf{717}_2$ complementary to the through holes $\mathbf{616}_1$ and $\mathbf{616}_2$ of the protective cushion pad 606, as best shown in FIGS. 54 and 57-59. The short hard cap 726 is non-removably (i.e., permanently) attached to the outer surface 607*a* of the protective cushion pad 606, as best shown in FIGS. 54 and 57-59, by utilizing snap fasteners 220, to form the outer protective unit 702. The male parts 222 of the snap fasteners 220 is configured to extend through the through holes $\mathbf{616}_1$ and $\mathbf{616}_2$ in the protective cushion pad 606, and the complementary through holes $\mathbf{717}_1$ and $\mathbf{717}_2$ in the short hard cap 726 to join the protective cushion pad 606 and the short hard cap 726 together, as best shown in FIGS. 54, 56, 58 and 59. Alternative methods of permanent attachment of the short hard cap 726 to the protective cushion pad 606, such as adhesive bonding and other mechanical fasteners (e.g., rivets, bolts- and nuts, etc.) are within the scope of the present invention. The male parts 222 and the female parts 224 of the snap fasteners 220 snap together to join the material of the protective cushion pad 606 and the short hard cap 726 between them, with the male parts 222 affixed from the protective cushion pad 606 and the female parts 224 of the snap fasteners 220 affixed from the short hard cap 726 as best shown in FIG. 54. With the snap fasteners 220 installed, the protective cushion pad 606 and the short hard cap 726 become a permanent unit and form the outer protective unit 702 as shown in FIGS. 54, 58 and 59.

Figure 55:
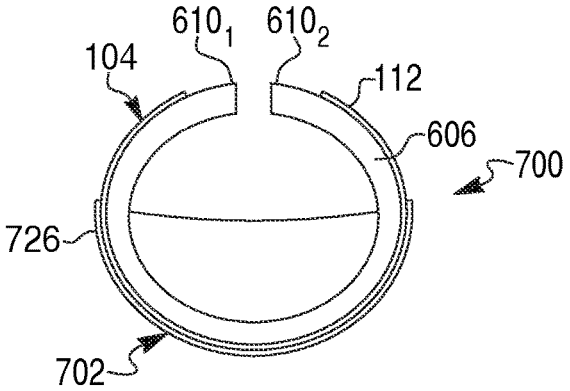
FIG. 55 is a bottom view of the protective pad assembly in accordance with the seventh exemplary embodiment of the present invention.

The outer protective unit 702 is removably connectable to the resilient retaining split-ring clamp 112 of the self-retaining device 104 to assemble the protective pad assembly 700. Specifically, the resilient split-ring clamp 112 is removably mountable (attachable) to the outer protective unit 702 by manually opening or spreading of the free ends $\mathbf{114}_1$ and $\mathbf{114}_2$ of the resilient retaining split-ring clamp 112, as shown in FIG. 59, placing the resilient split-ring clamp 112 over the protective cushion pad 606 and below the short hard cap 726 so that the free ends $\mathbf{114}_1$ and $\mathbf{114}_2$ of the resilient retaining split-ring clamp 112 are positioned over the side cushion portions $\mathbf{610}_1$ and $\mathbf{610}_2$ thereof, respectively, and then releasing the free ends $\mathbf{114}_1$ and $\mathbf{114}_2$ of the resilient retaining split-ring clamp 112 of the self-retaining device 104 to the side cushion portions $\mathbf{610}_1$ and $\mathbf{610}_2$ of the protective cushion pad 606, respectively, to form the protective pad assembly 700, as shown in FIGS. 54, 55 and 59.

Figure 60A:
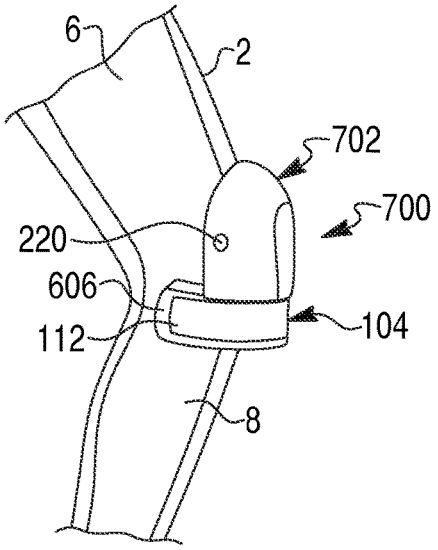
FIG. 60A shows the protective pad assembly in accordance with the seventh exemplary embodiment of the present invention mounted to a leg of a user wearing pants.
Figure 60B:
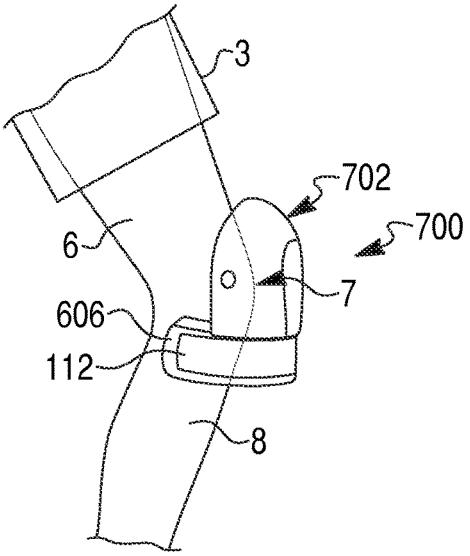
FIG. 60B shows the protective pad assembly in accordance with the seventh exemplary embodiment of the present invention mounted to the leg of the user wearing shorts.

The protective pad assembly 700 is attached to a lower leg area 8 of the leg 6 of the user (wearer) below and adjacent to the knee 7 as shown in FIGS. 60A and 60B. The protective pad assembly 700 is attachable to the user (wearer) by manually pulling open or spreading apart the free ends $\mathbf{114}_1$ and $\mathbf{114}_2$ of the resilient retaining split-ring clamp 112 of the self-retaining device 104 and the two side cushion portions $\mathbf{610}_1$ and $\mathbf{610}_2$ of the protective cushion pad 606 simultaneously, then releasing the free ends $\mathbf{114}_1$ and $\mathbf{114}_2$ of the resilient retaining split-ring clamp 112 and the side cushion portions $\mathbf{610}_1$ and $\mathbf{610}_2$ of the protective cushion pad 606 at the lower leg area 8 below the knee 7, as best shown in FIGS. 60A and 60B. The protective pad assembly 700 may be removed from the leg 6 by pulling open or spreading the free ends $\mathbf{114}_1$ and $\mathbf{114}_2$ of the resilient retaining split-ring clamp 112 and the side cushion portions $\mathbf{610}_1$ and $\mathbf{610}_2$ of the protective cushion pad 606 simultaneously, then separating and detaching the protective pad assembly 700 from the leg 6 of the user (wearer). Similarly, the protective pad assembly 700 can be attached to the leg 6 of the user wearing shorts 3, as best shown in FIG. 60B, and detached therefrom in the exact manner as previously described for the user wearing pants 2, shown in FIG. 60A.

It shall be appreciated that the protective pad assembly 700 is held in place at the knee 7 and lower leg area 9 of the leg 6 solely by resilient retaining split-ring clamp 112 of the self-retaining device 104 which generates and exerts forces of tension sufficient as to grab the leg 6 and clamp the outer protective unit 702 to the lower leg area 9 of the leg 6. The protective pad assembly 700 has an inherent spectrum of automatic pressure adjustments provided by the resilient retaining split-ring clamp 112 that enables the protective pad assembly 700 to adjust automatically to different size limbs and maintain sufficient tension to stay on the user (wearer).

The protective pad assembly 700 is attached to the leg 6 of the user (wearer) wearing pants 2 at the knee area 7 and the lower leg area 9 of the leg 6 as shown in FIGS. 60A. Alternately, the protective pad assembly 700 can also be attached to the leg 6 of the user wearing shorts 3 (shown in FIG. 60B), and detached in the exact manner as previously described for wearing pants.

Figure 61A:
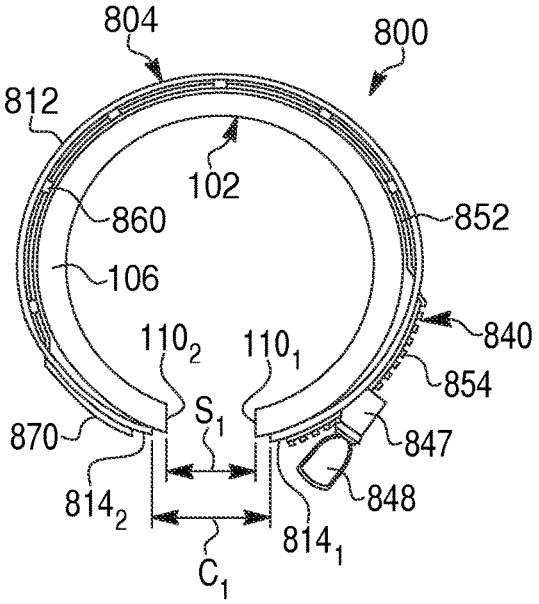
FIG. 61A is a bottom view of a protective pad assembly in accordance with an eighth exemplary embodiment of the present invention in an expanded position.
Figure 61B:
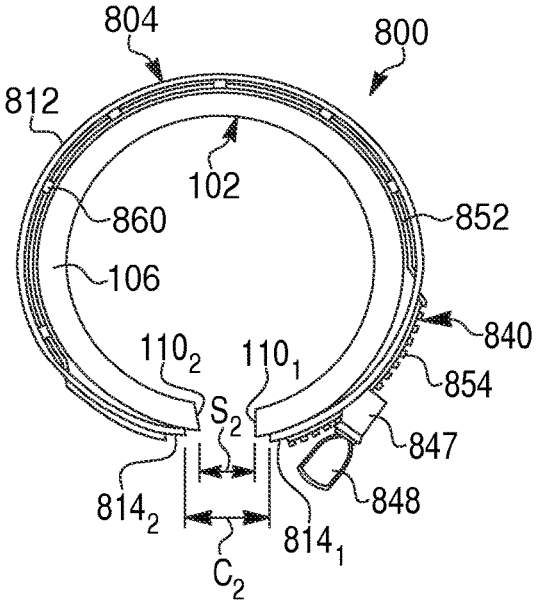
FIG. 61B is a bottom view of the protective pad assembly in accordance with the eighth exemplary embodiment of the present invention in a contracted position.

In a protective pad assembly 800 according to an eighth exemplary embodiment illustrated in FIGS. 61A-73 a manually adjustable, removeable self-retaining device 804 is utilized. The protective pad assembly 800 comprises an outer protective unit 102 configured to protect the elbow or the knee of the user from impact, and a manually adjustable, removeable self-retaining device 804. The manually adjustable self-retaining device 804 is removably mounted to the outer protective unit 102, as best shown in FIGS. 61A and 61B. Alternatively, the manually adjustable, removeable self-retaining device 804 may be used with the outer protective units of other previous exemplary embodiments.

Figure 62:
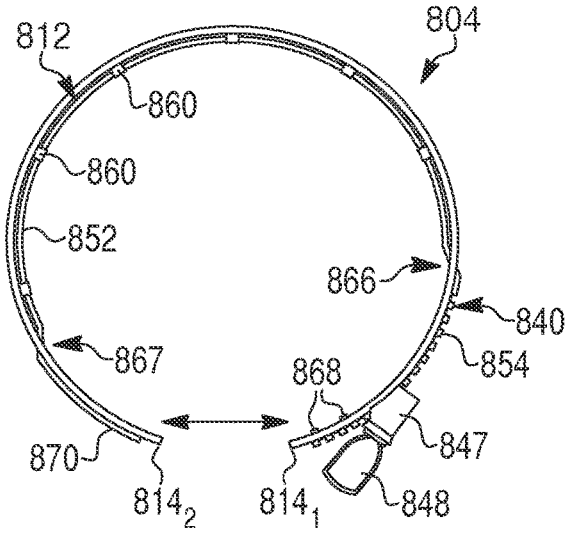
FIG. 62 shows a manually adjustable self-retaining device in accordance with the eighth exemplary embodiment of the present invention.

The manually adjustable self-retaining device 804 includes a self-retaining resilient split-ring clamp 812 and a manual override adjuster 840 mounted to the resilient split-ring clamp 812, as best shown in FIG. 62. The manual override adjuster 840 is provided to manually adjust the distance between the flexible side cushion portions $\mathbf{110}_1$ and $\mathbf{110}_2$ of the protective cushion pad 106 by adjusting the distance between the free ends $\mathbf{814}_1$ and $\mathbf{814}_2$ of the resilient split-ring clamp 812. The manual override adjuster 840, according to the exemplary embodiment, is a gear and rack assembly. The manually self-retaining adjustable device 804 with the manual override adjuster 840 is mountable to the flexible protective cushion pad 106, including the flexible side cushion portions $\mathbf{110}_1$ and $\mathbf{110}_2$ thereof, by the manually opening or spreading free ends $\mathbf{814}_1$ and $\mathbf{814}_2$ of the resilient split-ring clamp 812, best shown in FIG. 62. Next, the spreaded self-retaining adjustable device 804 with the manual override adjuster 840 is placed onto the protective cushion pad 106 with the flexible side cushion portions $\mathbf{110}_1$ and $\mathbf{110}_2$. Then, the free ends $\mathbf{814}_1$ and $\mathbf{814}_2$ of the resilient split-ring clamp 812 are released against the flexible protective cushion pad 106, thus mounting together the outer protective unit 102 and the manually adjustable self-retaining device 804 to form the protective pad assembly 800 shown in FIGS. 61A and 61B.

Figure 63:
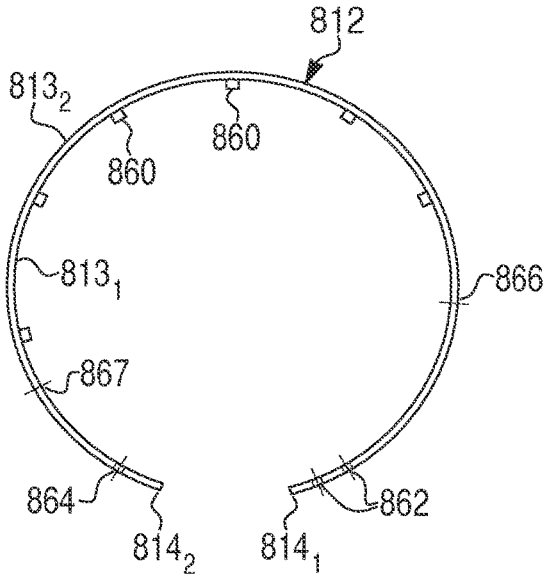
FIG. 63 is a top view of a self-retaining resilient split-ring clamp in accordance with the eighth exemplary embodiment of the present invention.
Figure 68A:
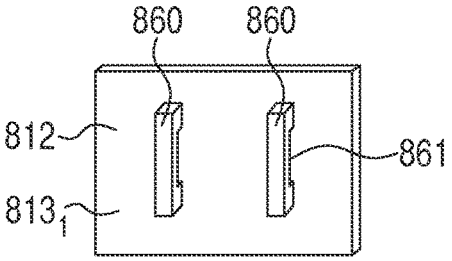
FIG. 68A shows a portion of a self-retaining resilient split-ring clamp with support brackets in accordance with the eighth exemplary embodiment of the present invention.
Figure 68B:
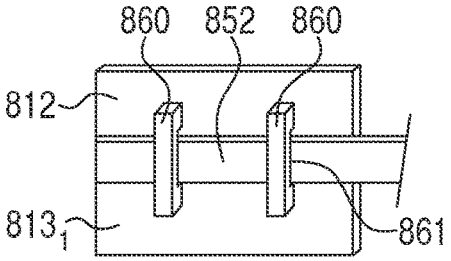
FIG. 68B shows a portion of the self-retaining resilient split-ring clamp with the support brackets and the toothed rack in accordance with the eighth exemplary embodiment of the present invention.
Figure 68C:
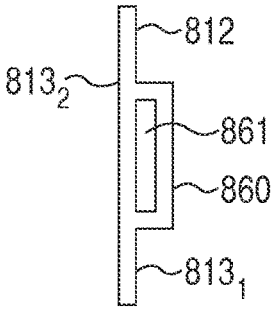
FIG. 68C is a side view of the self-retaining resilient split-ring clamp in accordance with the eighth exemplary embodiment of the present invention.
Figure 69:
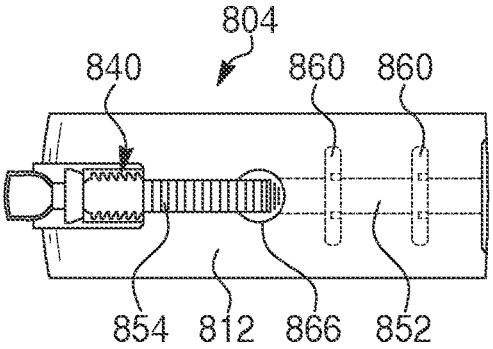
FIG. 69 is a side view of the manually adjustable self-retaining device in accordance with the eighth exemplary embodiment of the present invention showing the support brackets and a portion of the toothed rack in hidden lines.
Figure 70:
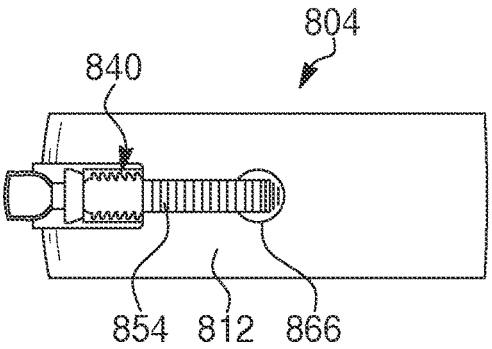
FIG. 70 is a side view of the manually adjustable self-retaining device in accordance with the eighth exemplary embodiment of the present invention.
Figure 71A:
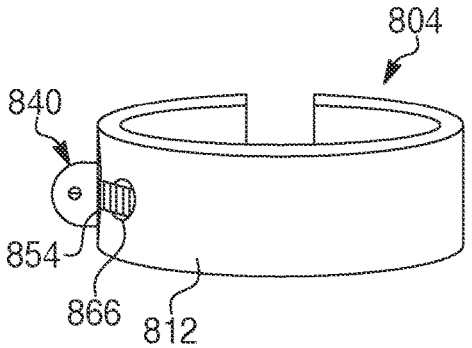
FIG. 71A is a front perspective view of the manually adjustable self-retaining device in accordance with the eighth exemplary embodiment of the present invention.
Figure 71B:
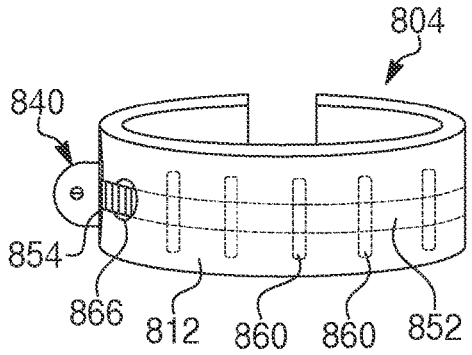
FIG. 71B is a front perspective view of the manually adjustable self-retaining device in accordance with the eighth exemplary embodiment of the present invention showing the support brackets and a portion of the toothed rack in hidden lines.
Figure 72A:
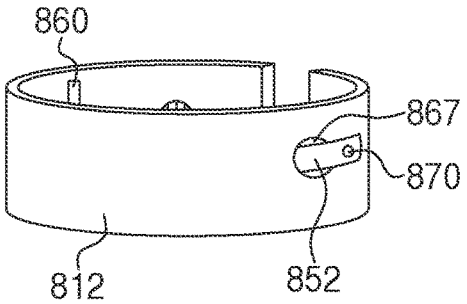
FIG. 72A is a left-side perspective view of the manually adjustable self-retaining device in accordance with the eighth exemplary embodiment of the present invention.
Figure 72B:
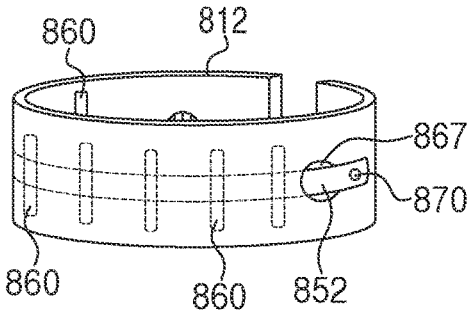
FIG. 72B is a left-side perspective view of the manually adjustable self-retaining device in accordance with the eighth exemplary embodiment of the present invention showing the support brackets and a portion of the toothed rack in hidden lines.
Figure 73:
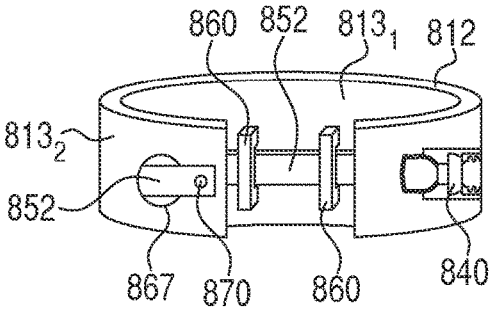
FIG. 73 is a rear perspective view of the manually adjustable self-retaining device in accordance with the eighth exemplary embodiment of the present invention.

The resilient split-ring clamp 812, best shown in FIG. 63, has an inner surface $\mathbf{813}_1$ and an outer surface $\mathbf{813}_2$. The split-ring clamp 812 has a plurality, such as six (6), of support brackets 860 formed integrally therewith and extending radially inwardly from of the inner surface $\mathbf{813}_1$ of the split-ring clamp 812, as best shown in FIGS. 63, 68A and 68C. The split-ring clamp 812 has two (2) small through holes 862 on one end thereof, and at least one (1) small through hole 864 on the opposite end side of the split-ring clamp 812, as shown in FIG. 63. Furthermore, the split-ring clamp 812 is formed with two (2) larger holes on the split-ring clamp 812, namely large access through hole 866 and large access through hole 867, also shown in FIG. 63.

Figure 64:
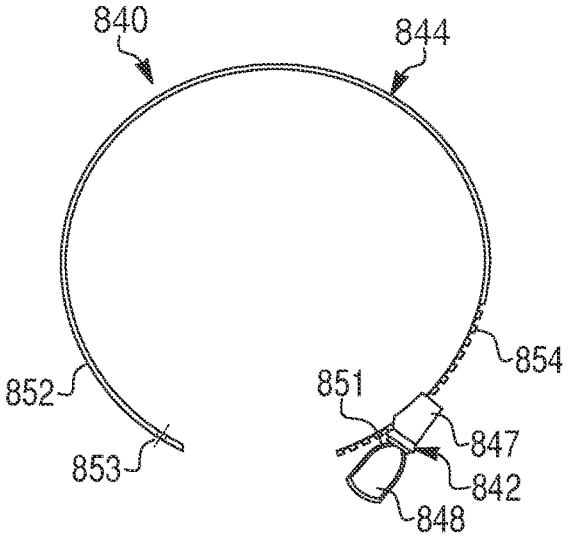
FIG. 64 shows a manual override adjuster in accordance with the eighth exemplary embodiment of the present invention.
Figure 65:
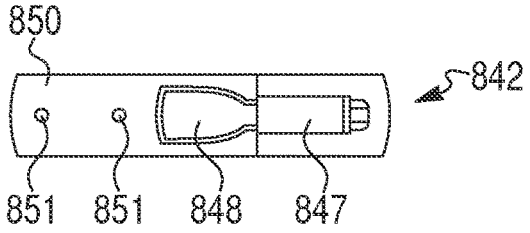
FIG. 65 shows a worm gear drive unit in accordance with the present invention.
Figure 66:
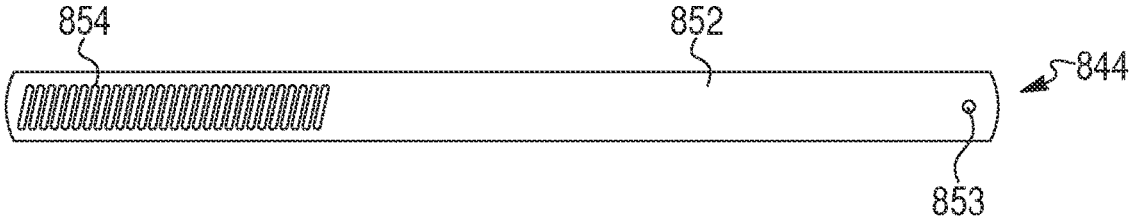
FIG. 66 shows a toothed rack in accordance with the present invention.
Figure 67:
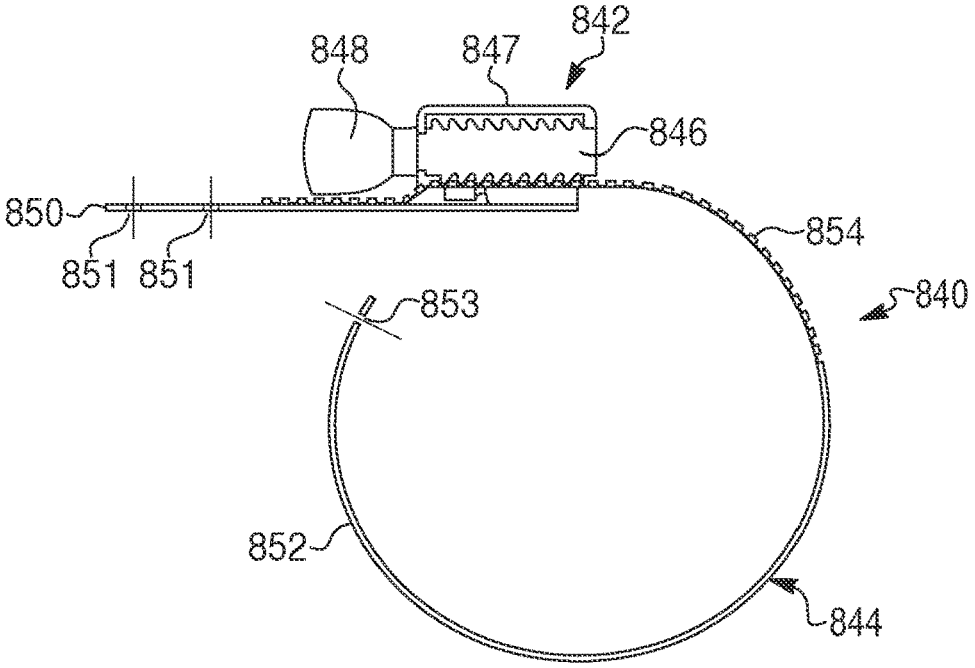
FIG. 67 shows a manual override adjuster in accordance with the present invention.

The manual override adjuster 840, best shown in FIG. 64, includes a worm gear drive unit 842, best shown in FIG. 65, and a toothed rack 854, best shown in FIG. 66. The worm gear drive unit 842 includes a worm gear 846 disposed in a worm gear housing 847, and a flat base 850, to which the worm gear 846 and the worm gear housing 847 are attached, as shown in FIGS. 65 and 67. The worm gear 846 is drivingly connected to a thumb knob 848 to rotate the worm gear 846 in the worm gear housing 847. In turn, the worm gear 846 moves the toothed rack 844 when rotated, as best shown in FIG. 67. Two (2) small through holes 851 are formed in the flat base 850 of the worm gear drive unit 842, as best shown in FIGS. 65 and 67. The toothed rack 844 includes a plain rack portion 852 and a rack teeth portion 854. The plain rack portion 852 is formed with at least one (1) small through hole 853 at a distal end of the plain rack portion 852 opposite to the rack teeth portion 854, as best shown in FIGS. 66 and 67. The worm gear drive unit 842 and the toothed rack 844 collectively define the manual override adjuster 840 in the form of the worm gear drive unit 842 and toothed rack 844, as illustrated in FIGS. 64 and 67. FIGS. 68A, 68B and 68C show sectional views where the support brackets 860 define U-shaped channels 861 and are configured to keep a portion of the plain rack portion 852 of the toothed rack 844 inline and in place against the inner surface $\mathbf{813}_1$ of the split-ring clamp 812.

The manual override adjuster 840 and the self-retaining split-ring clamp 812 are assembled together to form the manually adjustable, removeable self-retaining device 804 with the manual override adjuster 840, as shown in FIG. 62. in the following manner:

First, the worm gear drive unit 842 is mounted on the outer surface $\mathbf{813}_2$ of the split-ring clamp 812, as shown in FIG. 62. The two (2) small through holes 862 on one end of the s split-ring clamp 812 are lined up with the two (2) small through holes 851 of the flat base 850 of the worm gear drive unit 842 and receive two (2) rivets 868 that fasten and permanently fix (i.e., non-moveably secure) the flat base 850 of the worm gear drive unit 842 to the split-ring clamp 812, as best shown in FIGS. 62. Then, the rack teeth portion 854 of the toothed rack 844 is placed and fed into the worm gear housing 847, and a clockwise twist of the thumb knob 848 causes the worm gear 846 to engage and pull the rack teeth portion 854 into the worm gear housing 847, as shown in FIGS. 64 and 67. The plain rack portion 852 of the toothed rack 844 is first fed from the outer surface $\mathbf{813}_2$ of the split-ring clamp 812 into the large access through hole 866 of the split-ring clamp 812 and then down to the underside of the inner surface $\mathbf{813}_1$ of the split-ring clamp 812, as best shown in FIGS. 62, 71A, 71B and 72B. Then, the toothed rack 844 is fed through each one of the U-shaped channels 861 of the support brackets 860, as best shown in FIG. 68B. After the toothed rack 844 is fed into the last support brackets 860, the remaining length of the toothed rack 844 is fed into the large access through hole 867 from the bottom and/or the underside and upwards to the outer surface $\mathbf{813}_2$ of the split-ring clamp 812, as best shown in FIGS. 62, 72A, 72B and 73. The remaining length of the plain rack portion 852 of the toothed rack 844 is terminated and anchored (or fixed) in place on the outer surface $\mathbf{813}_2$ of the split-ring clamp 812 by a rivet 870 extending through the small through holes 864 and 853 of the split-ring clamp 812 and a distal end of the plain rack portion 852 of the toothed rack 844, respectively, as best shown in FIGS. 62-64.

It shall be appreciated that the manually adjustable self-retaining device 804 with the manual override adjuster 840 is interchangeable and can be used in various exemplary embodiments as described herein. For reference purposes we will choose and attach the manually adjustable self-retaining device 804 with the manual override adjuster 840 to the outer protective unit 102 of the first exemplary embodiment to explain its functionalities.

Thus, the protective pad assembly 800 of the eighth exemplary embodiment comprises the flexible outer protective unit 102 with the flexible side cushion portions $\mathbf{110}_1$ and $\mathbf{110}_2$, and the removeable, manually adjustable self-retaining device 804 with the manual override adjuster 840. The manually adjustable self-retaining device 804 is connectable to the outer protective unit 102 with the flexible side cushion portions $\mathbf{110}_1$ and $\mathbf{110}_2$ by, first, manually opening or spreading the free ends $\mathbf{814}_1$ and $\mathbf{814}_2$ of the resilient split-ring clamp 812 with the manual override adjuster 840 mounted thereon, as best shown in FIG. 62. Then, the spreaded manually adjustable self-retaining device 804 is placed onto the area of the outer protective unit 102 with the flexible side cushion portions $\mathbf{110}_1$ and $\mathbf{110}_2$. Then, the free ends $\mathbf{814}_1$ and $\mathbf{814}_2$ of the resilient split-ring clamp 812 to the flexible outer protective unit 102 are released to form the protective pad assembly 800, as shown in FIGS. 61A and 61B.

In operation, when the thumb knob 848 of the worm gear drive unit 842 is turned clockwise, the toothed rack 844 contracts and closes the flexible side cushion portions $\mathbf{110}_1$ and $\mathbf{110}_2$ of the outer protective unit 102 and the free ends $\mathbf{814}_1$ and $\mathbf{814}_2$ of the resilient split-ring clamp 812, thus enabling the resilient split-ring clamp 812 to create more tension by allowing incremental adjustments and variable comfort zones for the wearer (user), as shown in FIG. 61B illustrating the resilient split-ring clamp 812 in a contracted position. Turning the thumb knob 848 of the worm gear drive unit 842 clockwise reduces the distance between the free ends $\mathbf{814}_1$ and $\mathbf{814}_2$ of the resilient split-ring clamp 812 to a distance $C_2$. Correspondingly, the distance between the flexible side cushion portions $\mathbf{110}_1$ and $\mathbf{110}_2$ of the outer protective unit 102 is reduced a distance $S_2$. On the other hand, turning the thumb knob 848 of the manual override adjuster 840 counterclockwise causes the toothed rack 844 to expand and open the flexible side cushion portions $\mathbf{110}_1$ and $\mathbf{110}_2$ of the outer protective unit 102 and spread the free ends $\mathbf{814}_1$ and $\mathbf{814}_2$ of the resilient split-ring clamp 812, thus enabling the protective pad assembly 800 to create less tension by allowing incremental adjustments and variable comfort zones for the wearer (user), as shown in FIG. 61A illustrating the resilient split-ring clamp 812 in an expanded position. Turning the thumb knob 848 of the worm gear drive unit 842 counterclockwise increases the distance between the free ends $\mathbf{814}_1$ and $\mathbf{814}_2$ of the resilient split-ring clamp 812 to a distance $C_1$. Correspondingly, the distance between the flexible side cushion portions $\mathbf{110}_1$ and $\mathbf{110}_2$ of the outer protective unit 102 is increased a distance $S_1$. Thus, rotation of the thumb knob 848 of the worm gear drive unit 842 controls (or adjusts) the distance between the free ends $\mathbf{814}_1$ and $\mathbf{814}_2$ of the resilient split-ring clamp 812, and allows incremental adjustments and variable comfort zones for the wearer (user).

It shall be appreciated that the protective pad assembly 800 has the capability to allow the resiliency of the split-ring clamp 812 to be manually adjusted to create and exert inherent forces of tension as to grab and hug the lower leg area 8, to which the manually adjustable, removeable self-retaining device 804 is attached. The protective pad assembly 800 of the eighth exemplary embodiment is attached to the leg of the user (wearer) and removed in the exact fashion as described in the prior exemplary embodiments of the present invention.

Figure 74A:
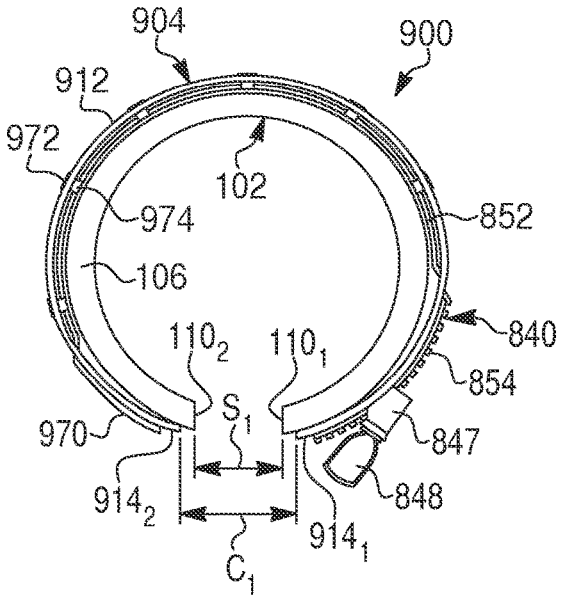
FIG. 74A is a bottom view of a protective pad assembly in accordance with a ninth exemplary embodiment of the present invention in an expanded position.
Figure 74B:
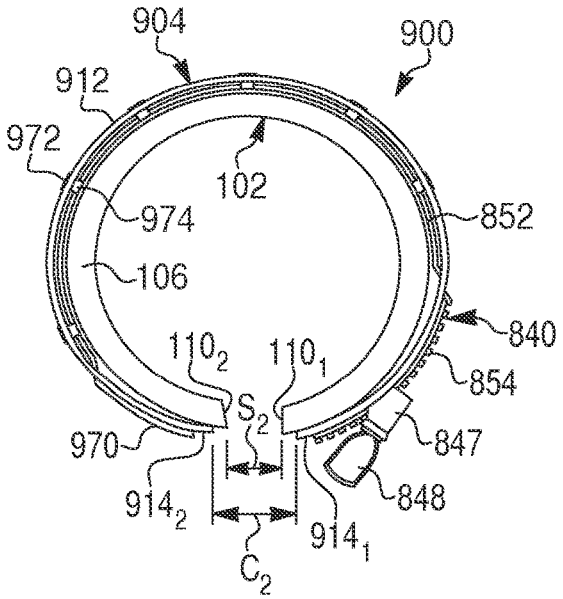
FIG. 74B is a bottom view of the protective pad assembly in accordance with the ninth exemplary embodiment of the present invention in a contracted position.

In a protective pad assembly 900 according to a ninth exemplary embodiment illustrated in FIGS. 74A-79, the manually adjustable, removeable self-retaining device 804 of the eighth exemplary embodiment (or the removeable self-retaining devices of other previous exemplary embodiments) is replaced with a manually adjustable, removeable self-retaining device 904. The protective pad assembly 900 comprises an outer protective unit 102 configured to protect the elbow or the knee of the user from impact, and a manually adjustable, removeable self-retaining device 904. The manually adjustable self-retaining device 904 is removably mounted to the outer protective unit 102, as best shown in FIGS. 74A and 74B. Alternatively, the manually adjustable, removeable self-retaining device 904 of the ninth exemplary embodiment may be used with the outer protective units of other previous exemplary embodiments.

Figure 75:
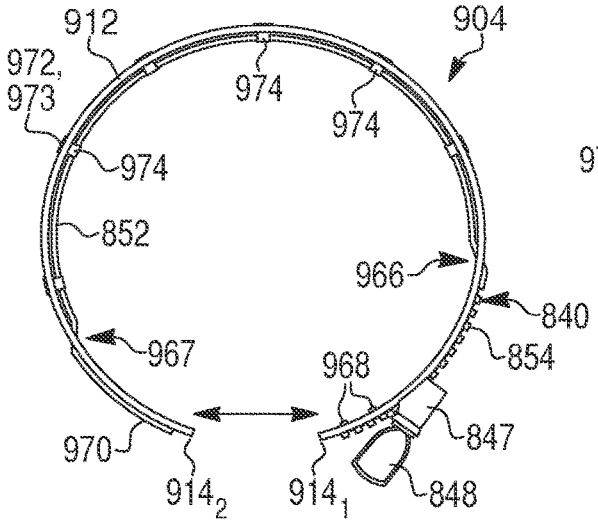
FIG. 75 shows a manually adjustable self-retaining device in accordance with the ninth exemplary embodiment of the present invention.

The manually adjustable self-retaining device 904 includes a self-retaining resilient split-ring clamp 912 and the manual override adjuster 840 mounted to the resilient split-ring clamp 912, as best shown in FIG. 75. The manually self-retaining adjustable device 904 with the manual override adjuster 840 is mountable to the flexible protective cushion pad 106, including the flexible side cushion portions $\mathbf{110}_1$ and $\mathbf{110}_2$, by manually opening or spreading free ends $\mathbf{914}_1$ and $\mathbf{914}_2$ of the resilient split-ring clamp 912, best shown in FIG. 75. Next, the spreaded self-retaining adjustable device 904 with the manual override adjuster 840 is placed onto the area of the protective cushion pad 106 with the flexible side cushion portions $\mathbf{110}_1$ and $\mathbf{110}_2$. Then, the free ends $\mathbf{914}_1$ and $\mathbf{914}_2$ of the resilient split-ring clamp 912 are released onto the flexible protective cushion pad 106, thus mounting together the outer protective unit 102 and the manually adjustable self-retaining device 904 to form the protective pad assembly 900 shown in FIGS. 74A and 74B.

Figure 76:
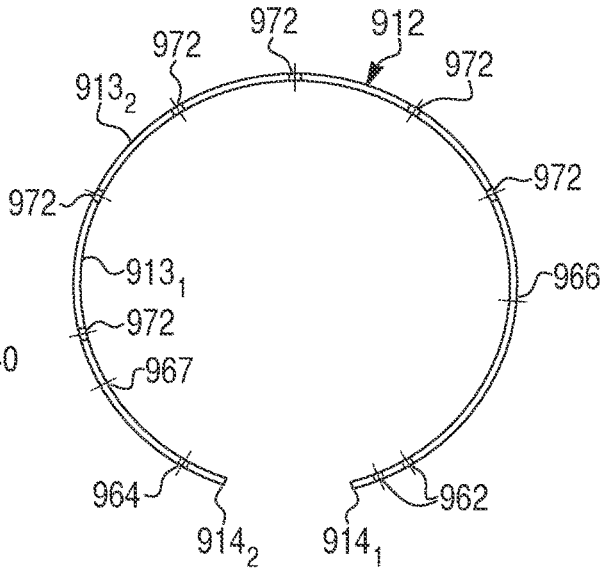
FIG. 76 shows a self-retaining resilient split-ring clamp in accordance with the ninth exemplary embodiment of the present invention.

The resilient split-ring clamp 912, best shown in FIG. 76, has an inner surface $\mathbf{913}_1$ and an outer surface $\mathbf{913}_2$. The split-ring clamp 912 is a split (or incomplete) round ring with spaced free ends $\mathbf{914}_1$ and $\mathbf{914}_2$ as shown in FIG. 76. The resilient split-ring clamp 912 works like a spring clamp that is both rigid and flexible, and can be made from formable resilient materials including plastics such as ABS or PVC, composites, or spring steel. The resilient split-ring clamp 912 has an inherent spectrum of preloaded tensions that provides automatic pressure adjustments. The split-ring clamp 912 has two (2) small through holes 962 on one end, and at least one (1) small through hole 964 on the opposite end side of the split-ring clamp 912, as best shown in FIG. 76. Furthermore, the split-ring clamp 912 is formed with two (2) larger holes, namely large access through hole 966 and large access through hole 967, also best shown in FIG. 76.

Figure 77A:
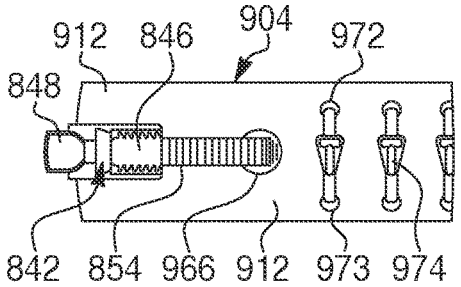
FIG. 77A is a side view of the manually adjustable self-retaining device in accordance with the ninth exemplary embodiment of the present invention.
Figure 77B:
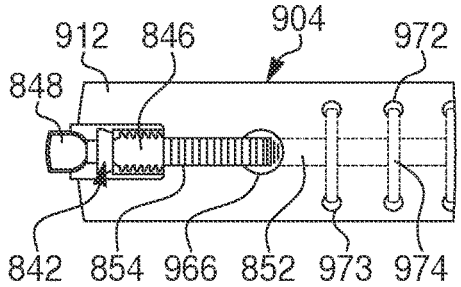
FIG. 77B is a side view of the manually adjustable self-retaining device in accordance with the ninth exemplary embodiment of the present invention showing cable ties and a portion of the toothed rack in hidden lines.
Figure 78:
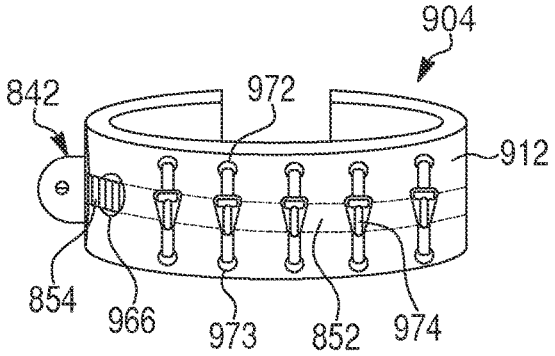
FIG. 78 is a front perspective view of the manually adjustable self-retaining device in accordance with the ninth exemplary embodiment of the present invention showing the portion of the toothed rack in hidden lines.
Figure 79:
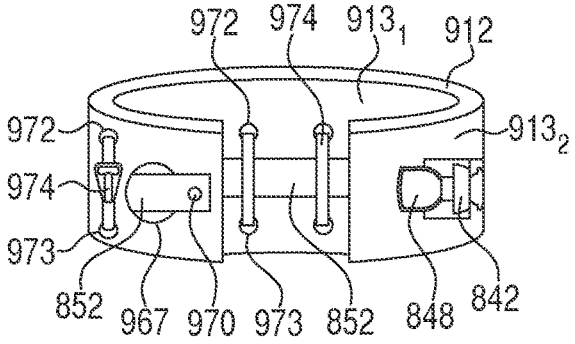
FIG. 79 is a rear perspective view of the manually adjustable self-retaining device in accordance with the ninth exemplary embodiment of the present invention.

The resilient split-ring clamp 912 is formed with a plurality, such as twelve (12), small through holes arrayed in line and parallel to each other along the resilient split-ring clamp 912. There are a plurality, such as six (6), top holes 972 and a plurality, such as six (6), bottom holes 973, best shown in FIGS. 76, 77A, 77B, 78 and 79. The purpose of the plurality of small through holes 972 and 973 collectively, is to readily accept and have installed a plurality, such as six (6), cable ties 974 therethrough, as shown in FIGS. FIGS. 77A, 77B, 78 and 79. The six (6) cable ties 974 keep a portion of the plain rack portion 852 of the toothed rack 844 inline and in place against the inner circular surface $\mathbf{913}_1$ of the split-ring clamp 912, as best shown FIGS. 75 and 77A-79. Basically, the cable ties 974 are an alternative to the support brackets 860, as described regarding the eighth exemplary embodiment. Furthermore, the cable ties 974 are installed from the side of the outer circular surface $\mathbf{913}_2$ and the top through the top holes 972 first then, placed over the toothed rack 844 and then fed through the bottom holes 973, and out the front of the outer circular surface $\mathbf{913}_2$ as shown in FIGS. 77A-79. Each of the cable ties 974 is then connected and tightened at the front of the outer circular surface $\mathbf{913}_2$ of the split-ring clamp 912 as shown in FIGS. 77A and 78. FIG. 77A is a side frontal view of the outer circular surface $\mathbf{913}_2$ showing the placement of the finished cable ties 974 as mounted to through the holes 972 and 973. FIG. 79 is a back side view of the inner circular surface $\mathbf{913}_1$ showing placement and the back side of the cable ties 974 as mounted to through the holes 972 and 973. After all the six (6) cable ties 974 are installed, the remaining length of the toothed rack 844 is then fed into the large access through hole 967 from the underside and/or the inner circular surface $\mathbf{913}_1$, and then fed upwards to the outer surface $\mathbf{913}_2$ of the manually adjustable self-retaining device 904, as best shown in FIGS. 75 and 77A-79. The last remaining length of the toothed rack 844 is terminated and anchored in place on the outer surface $\mathbf{913}_2$ of the split-ring clamp 912 by a rivet 970, which joins the small through hole 964 of the self-retaining resilient split-ring clamp 912 and the manual override adjuster 840, respectively, as best shown FIGS. 75, 76 and 79.

In a protective pad assembly 1000 according to a tenth exemplary embodiment illustrated in FIGS. 80A-82, the manually adjustable, removeable self-retaining device 904 of the ninth exemplary embodiment (or the removeable self-retaining devices of other previous exemplary embodiments) is replaced with a manually adjustable, removeable self-retaining device 1004. The protective pad assembly 1000 comprises an outer protective unit 102 configured to protect the elbow or the knee of the user from impact, and a manually adjustable, removeable self-retaining device 1004. The manually adjustable self-retaining device 1004 is removably mounted to the outer protective unit 102. Alternatively, the manually adjustable, removeable self-retaining device 1004 of the tenth exemplary embodiment may be used with the outer protective units of other previous exemplary embodiments.

Figure 80A:
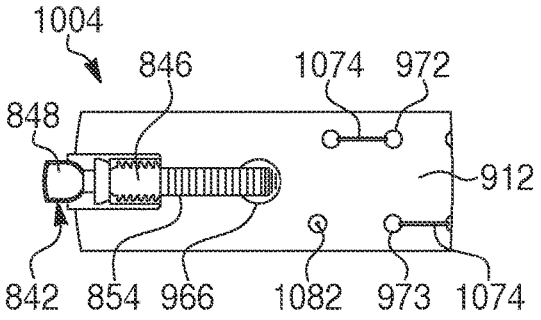
FIG. 80A is a side view of a manually adjustable self-retaining device in accordance with a tenth exemplary embodiment of the present invention.
Figure 80B:
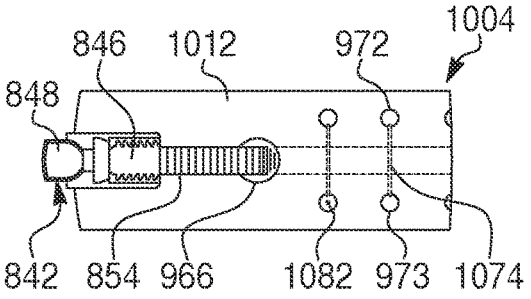
FIG. 80B is a side view of the manually adjustable self-retaining device in accordance with the tenth exemplary embodiment of the present invention showing a braided cord and a portion of the toothed rack in hidden lines.
Figure 81A:
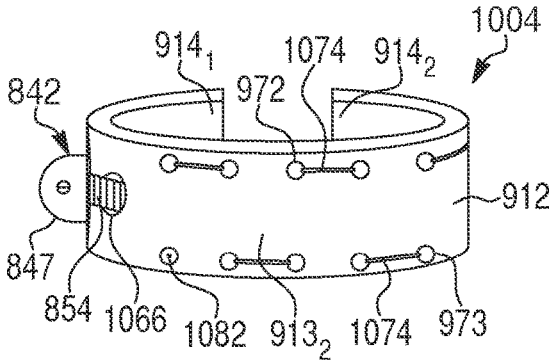
FIG. 81A is a front perspective view of the manually adjustable self-retaining device in accordance with the tenth exemplary embodiment of the present invention.
Figure 81B:
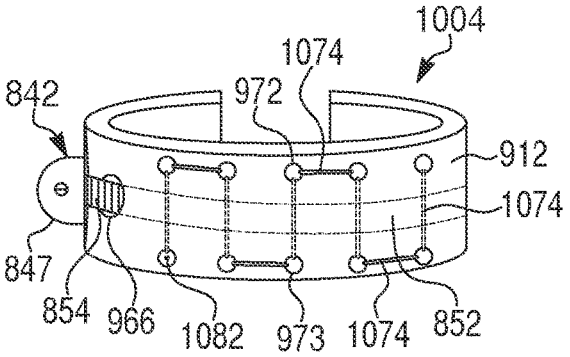
FIG. 81B is a front perspective view of the manually adjustable self-retaining device in accordance with the tenth exemplary embodiment of the present invention showing the braided cord and the portion of the toothed rack in hidden lines.
Figure 82:
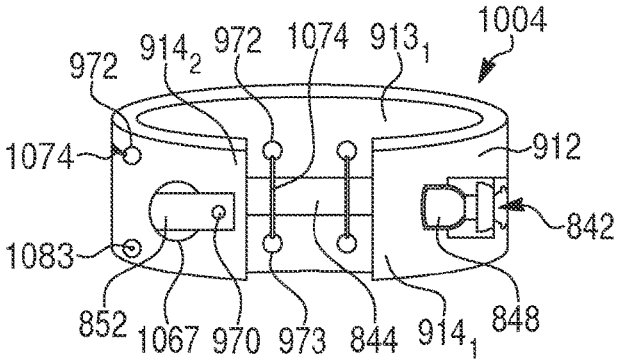
FIG. 82 is a rear perspective view of the manually adjustable self-retaining device in accordance with the tenth exemplary embodiment of the present invention.

The manually adjustable self-retaining device 1004 includes a self-retaining resilient split-ring clamp 912 and the manual override adjuster 840 mounted to the resilient split-ring clamp 912, as best shown in FIGS. 80A and 80B. The manually self-retaining adjustable device 1004 with the manual override adjuster 840 is mountable to the flexible protective cushion pad 106 by manually opening or spreading free ends $\mathbf{914}_1$ and $\mathbf{914}_2$ of the resilient split-ring clamp 912, best shown in FIGS. 81A and 82. Next, the spreaded self-retaining adjustable device 1004 with the manual override adjuster 840 is placed onto the area of the protective cushion pad 106 with the flexible side cushion portions $\mathbf{110}_1$ and $\mathbf{110}_2$. Then, the free ends $\mathbf{914}_1$ and $\mathbf{914}_2$ of the resilient split-ring clamp 912 are released onto the flexible protective cushion pad 106, thus mounting together the outer protective unit 102 and the manually adjustable self-retaining device 1004 to form the protective pad assembly 1000.

The removeable self-retaining adjustable device 1004 further includes a single braided cord 1074, as shown in FIGS. 80A-82, which substitutes and functions similarly to the cable ties 974 of the ninth exemplary embodiment. FIGS. 80A-82 illustrate the placement of the braided cord 1074 in relationship to the top through holes 972 and the bottom holes 973 through the split-ring clamp 912. The braided cord 1074 is positioned onto the outer circular surface $\mathbf{913}_2$ of the split-ring clamp 912 and positioned on the inner surface $\mathbf{913}_1$ so that the braided cord 1074 affixed to the small through holes 972 and 973. In this way the braided cord 1074 wrapped over the toothed rack 844, which the braided cord 1074 holds and keeps in position the toothed rack 844 against the inner surface $\mathbf{913}_1$ of the split-ring clamp 912. The braided cord 1074 is a single length of cord and is fed preferably through all the twelve (12) small through holes 972 and 973, starting with the first bottom (or starter) hole 973 nearest the large through hole 966, as shown FIGS. 80A-81B. The braided cord 1074 is affixed at the starter hole 973 by a rivet 1082, fed through all of the small through holes 972 and 973, and terminated and affixed at the last bottom hole 973 by a rivet 1083, as best shown FIG. 82.

Thus, the small through holes 972 and 973 readily accept and receive the braided cord 1074, as shown in FIGS. 80A-82. The braided cord 1074 keeps the toothed rack 844 inline and in place against the inner circular surface $\mathbf{913}_1$ of the split-ring clamp 912, as best shown FIGS. 80B, 81B and 82. Basically, the braided cord 1074 is an alternative to the cable ties 974, as described regarding the ninth exemplary embodiment. Therefore, the functionality and methods of use of the protective pad assemblies according to the tenth exemplary embodiment and the ninth exemplary embodiment are essentially the same.

Figure 83A:
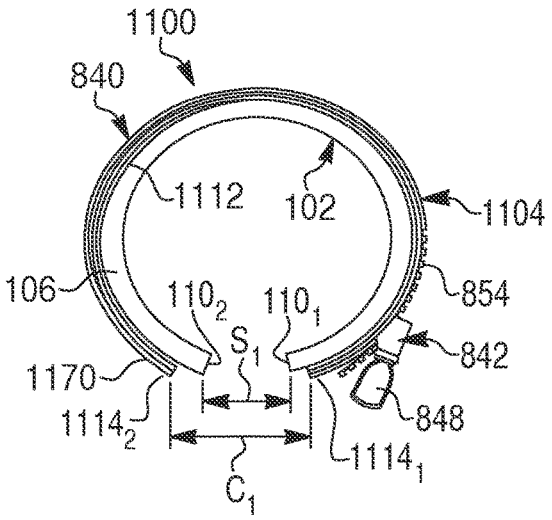
FIG. 83A is a bottom view of a protective pad assembly in accordance with an eleventh exemplary embodiment of the present invention in an expanded position.

In a protective pad assembly 1100 according to an eleventh exemplary embodiment illustrated in FIGS. 83A-90, the manually adjustable, removeable self-retaining device 1004 of the tenth exemplary embodiment (or the removeable self-retaining devices of other previous exemplary embodiments) is replaced with a manually adjustable, removeable self-retaining device 1104. The protective pad assembly 1100 comprises an outer protective unit 102 configured to protect the elbow or the knee of the user from impact, and the manually adjustable, removeable self-retaining device 1104, as best shown in FIGS. 83A and 83B. The manually adjustable self-retaining device 1104 is removably mounted to the outer protective unit 102. Alternatively, the manually adjustable, removeable self-retaining device 1104 of the eleventh exemplary embodiment may be used with the outer protective units of other previous exemplary embodiments.

Figure 83B:
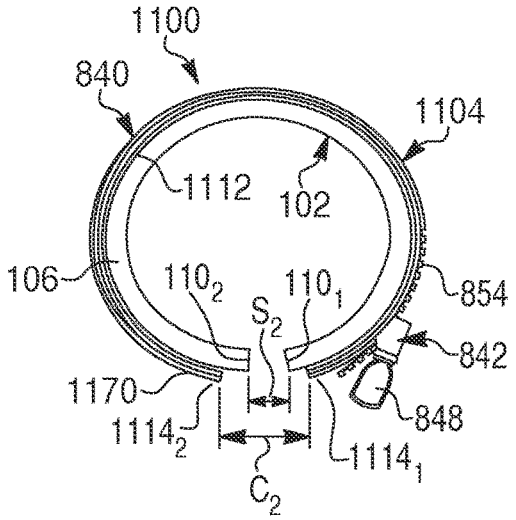
FIG. 83B is a bottom view of the protective pad assembly in accordance with the eleventh exemplary embodiment of the present invention in a contracted position.
Figure 84A:
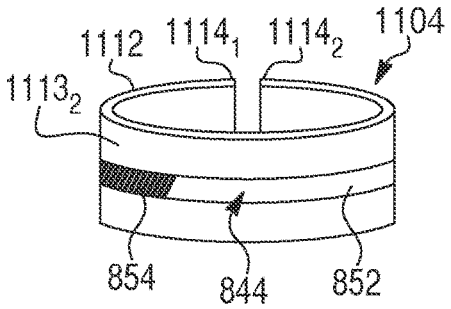
FIG. 84A is a front perspective view of the manually adjustable self-retaining device in accordance with the eleventh exemplary embodiment of the present invention.
Figure 84B:
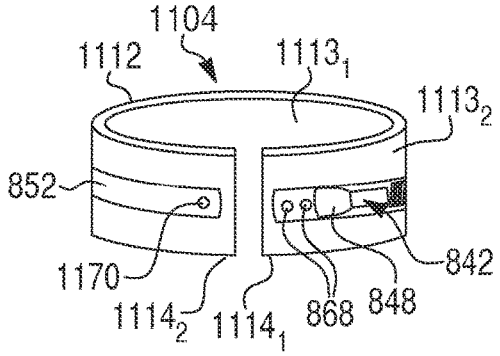
FIG. 84B is a rear perspective view of the manually adjustable self-retaining device in accordance with the eleventh exemplary embodiment of the present invention.
Figure 85:
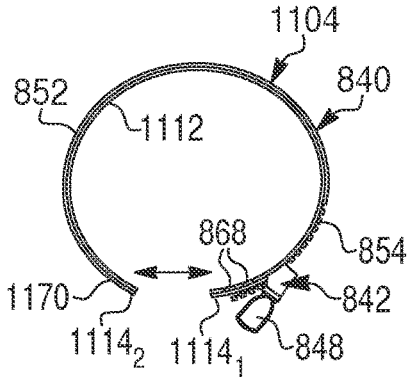
FIG. 85 shows a manually adjustable self-retaining device in accordance with the eleventh exemplary embodiment of the present invention.

The manually adjustable self-retaining device 1104 includes a self-retaining resilient split-ring clamp 1112 and the manual override adjuster 840 mounted to the resilient split-ring clamp 1112, as best shown in FIGS. 84A-85. The manually self-retaining adjustable device 1104 with the manual override adjuster 840 is mountable to the flexible protective cushion pad 106 by manually opening or spreading free ends $\mathbf{1114}_1$ and $\mathbf{1114}_2$ of the resilient split-ring clamp 1112, best shown in FIGS. FIGS. 84A-85. Next, the self-retaining adjustable device 1104 with the manual override adjuster 840 is placed onto the area of the protective cushion pad 106 with the flexible side cushion portions $\mathbf{110}_1$ and $\mathbf{110}_2$. Then, the free ends $\mathbf{1114}_1$ and $\mathbf{1114}_2$ of the resilient split-ring clamp 1112 are released onto the flexible protective cushion pad 106, thus mounting together the outer protective unit 102 and the manually adjustable self-retaining device 1104 to form the protective pad assembly 1100, as best shown in FIGS. 83A and 83B.

Figure 86:
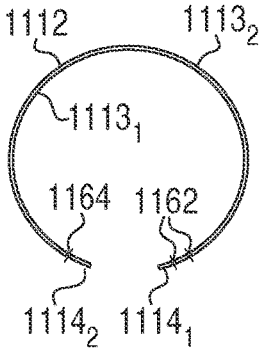
FIG. 86 is a top view of a self-retaining resilient split-ring clamp in accordance with the eleventh exemplary embodiment of the present invention.
Figure 87:
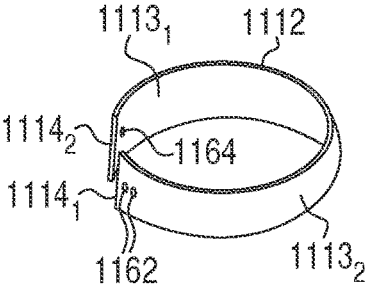
FIG. 87 is a perspective view of a self-retaining resilient split-ring clamp in accordance with the eleventh exemplary embodiment of the present invention.

The resilient split-ring clamp 1112, best shown in FIGS. 86 and 87, has an inner surface $\mathbf{1113}_1$ and an outer surface $\mathbf{1113}_2$. The split-ring clamp 1112 is a split (or incomplete) round ring with spaced free ends $\mathbf{1114}_1$ and $\mathbf{1114}_2$ as shown in FIGS. 86 and 87. The resilient split-ring clamp 1112 works like a spring clamp that is both rigid and flexible, and can be made from formable resilient materials including plastics such as ABS or PVC, composites, or spring steel. The resilient split-ring clamp 1112 has an inherent spectrum of preloaded tensions that provides automatic pressure adjustments. The split-ring clamp 1112 is formed with two (2) small through holes 1162 on one end, and at least one (1) small through hole 1164 on the opposite end side of the split-ring clamp 1112, as best shown in FIGS. 86 and 87.

The manual override adjuster 840, which includes the worm gear drive unit 842 and the toothed rack 844, is mounted to the outer circular surface $\mathbf{1113}_2$ of the split-ring clamp 1112, as best shown in FIGS. 84A and 84B, to form the manually adjustable, removeable self-retaining device 1104 with the manual override adjuster 840 in accordance with the eleventh exemplary embodiment shown in FIGS. 84A-85. The two (2) small through holes 1162 on the free end $\mathbf{1114}_1$ of the split-ring clamp 1112 (best shown in FIGS. 86 and 87), line up with the two (2) small through holes 851 (best shown in FIGS. 65 and 67) through the toothed rack 844 (best shown in FIGS. 86 and 87), and accept two (2) rivets 868 in order to fasten and permanently hold the worm gear drive unit 842 to the outer surface $\mathbf{1113}_2$ of the split-ring clamp 1112. The small through hole 1164 at the free end $\mathbf{1114}_2$ of the split-ring clamp 1112 lines up with the small through hole 853 (best shown in FIGS. 64 and 66) of the toothed rack 844 and accepts a rivet 1170 to fasten and permanently hold the toothed rack 844 to the outer circular surface $\mathbf{1113}_2$ of the split-ring clamp 1112, as best shown FIG. 84B.

Figure 88:
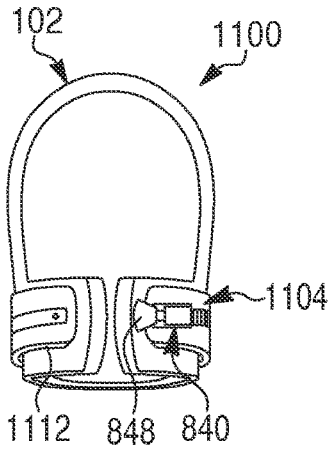
FIG. 88 is a perspective view of the protective pad assembly in accordance with the eleventh exemplary embodiment of the present invention.
Figure 89:
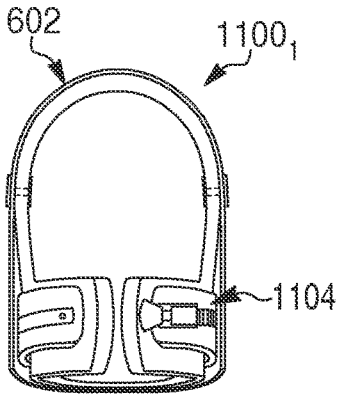
FIG. 89 is a perspective view of a protective pad assembly comprising the manually adjustable self-retaining device of the eleventh exemplary embodiment and the outer protective unit of the sixth exemplary embodiment.
Figure 90:
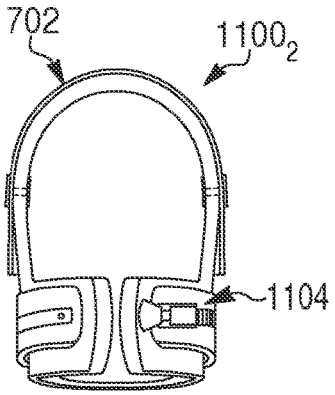
FIG. 90 is a perspective view of a protective pad assembly comprising the manually adjustable self-retaining device of the eleventh exemplary embodiment and the outer protective unit of the seventh exemplary embodiment.

It shall be appreciated that the manually self-retaining adjustable device 1104 is interchangeable and can be used and attached to outer protective units according to the multiple exemplary embodiments, some examples of which are shown in FIGS. 88-90. Specifically, FIG. 88 illustrates the protective pad assembly 1100 comprising the manually adjustable, removeable self-retaining device 1104 attached to the outer protective unit 102 of the first exemplary embodiment, FIG. 89 illustrates a protective pad assembly 11001 comprising the manually adjustable, removeable self-retaining device 1104 attached to the outer protective unit 602 of the sixth exemplary embodiment, and FIG. 90 illustrates a protective pad assembly 11002 comprising the manually adjustable, removeable self-retaining device 1104 attached to the outer protective unit 702 of the seventh exemplary embodiment.

Now, as an example and for reference purposes, the process (or method) of using the protective pad assembly 1100 of the eleventh exemplary embodiment follows. The manually adjustable, removeable self-retaining device 1104 is connectable to the flexible protective cushion pad 106 of the outer protective unit 102 by, first, manually opening or spreading the free ends $\mathbf{1114}_1$ and $\mathbf{1114}_2$ of the resilient split-ring clamp 1112, best shown in FIG. 85. Next, the self-retaining adjustable device 1104 with the manual override adjuster 840 is placed onto the area of the protective cushion pad 106 with the flexible side cushion portions $\mathbf{110}_1$ and $\mathbf{110}_2$. Then, the free ends $\mathbf{1114}_1$ and $\mathbf{1114}_2$ of the resilient split-ring clamp 1112 are released onto the flexible protective cushion pad 106, thus mounting together the outer protective unit 102 and the manually adjustable self-retaining device 1104 to form the protective pad assembly 1100 shown in FIGS. 83A, 83B and 87.

In operation, when the thumb knob 848 of the worm gear drive unit 842 is turned clockwise, the toothed rack 844 expands and opens the flexible side cushion portions $\mathbf{110}_1$ and $\mathbf{110}_2$ of the outer protective unit 102 and the free ends $\mathbf{1114}_1$ and $\mathbf{1114}_2$ of the resilient split-ring clamp 1112, thus enabling the resilient split-ring clamp 1112 to create less pressure and allowing incremental adjustments and variable comfort zones for the wearer (user), as shown in FIG. 83A. Turning the thumb knob 848 of the worm gear drive unit 842 clockwise increases the distance between the free ends $\mathbf{1114}_1$ and $\mathbf{1114}_2$ of the resilient split-ring clamp 1112 a distance $C_1$. Correspondingly, the distance between the flexible side cushion portions $\mathbf{110}_1$ and $\mathbf{110}_2$ of the outer protective unit 102 is increased a distance $S_1$. On the other hand, turning the thumb knob 848 of the manual override adjuster 840 counterclockwise causes the toothed rack 844 to contract and to close the flexible side cushion portions $\mathbf{110}_1$ and $\mathbf{110}_2$ of the outer protective unit 102 and the free ends $\mathbf{1114}_1$ and $\mathbf{1114}_2$ of the resilient split-ring clamp 1112, thus enabling the protective pad assembly 1100 to create more tension by allowing incremental adjustments and variable comfort zones for the wearer (user), as shown in FIG. 83B. In other words, turning the thumb knob 848 of the worm gear drive unit 842 counterclockwise reduces the distance between the free ends $\mathbf{1114}_1$ and $\mathbf{1114}_2$ of the resilient split-ring clamp 1112 to distance $C_2$. Correspondingly, the distance between the flexible side cushion portions $\mathbf{110}_1$ and $\mathbf{110}_2$ of the outer protective unit 102 is reduced a distance $S_2$. Thus, rotation of the thumb knob 848 of the worm gear drive unit 842 controls the distance between the free ends $\mathbf{1114}_1$ and $\mathbf{1114}_2$ of the resilient split-ring clamp 1112, and allows incremental adjustments and variable comfort zones for the wearer (user).

It shall be appreciated that the protective pad assembly 1100 has the capability to manually adjust the resiliency of the split-ring clamp 1112 to create and exert inherent forces of tension to grab and hug the lower leg area 8, to which the manually adjustable, removeable self-retaining device 1104 is attached. The protective pad assembly 1100 of the eleventh exemplary embodiment is attached to the leg of the user (wearer) and removed in the exact fashion as described in the prior exemplary embodiments of the present invention.

Figure 91A:
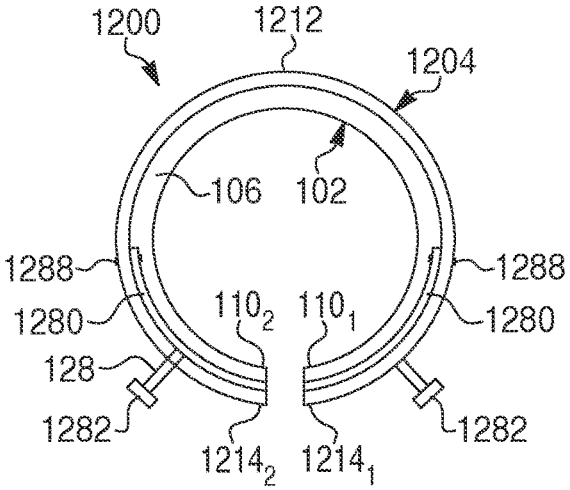
FIG. 91A is a bottom view of a protective pad assembly in accordance with a twelfth exemplary embodiment of the present invention in an expanded position.

In a protective pad assembly 1200 according to a twelfth exemplary embodiment illustrated in FIGS. 91A-98, the manually adjustable, removeable self-retaining device 1104 of the eleventh exemplary embodiment (or the removeable self-retaining devices of other previous exemplary embodiments) is replaced with a manually adjustable, removeable self-retaining device 1204. The protective pad assembly 1200 comprises an outer protective unit 102 configured to protect the elbow or the knee of the user from impact, and the manually adjustable, removeable self-retaining device 1204, as best shown in FIGS. 91A and 91B. The manually adjustable self-retaining device 1204 is removably mounted to the outer protective unit 102. Alternatively, the manually adjustable, removeable self-retaining device 1204 of the twelfth exemplary embodiment may be used with the outer protective units of other previous exemplary embodiments.

Figure 94:
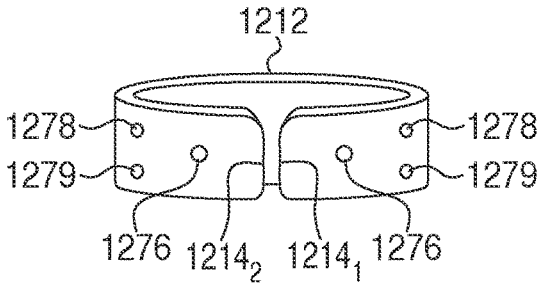
FIG. 94 is a perspective view of a self-retaining resilient split-ring clamp in accordance with the twelfth exemplary embodiment of the present invention.
Figure 95:
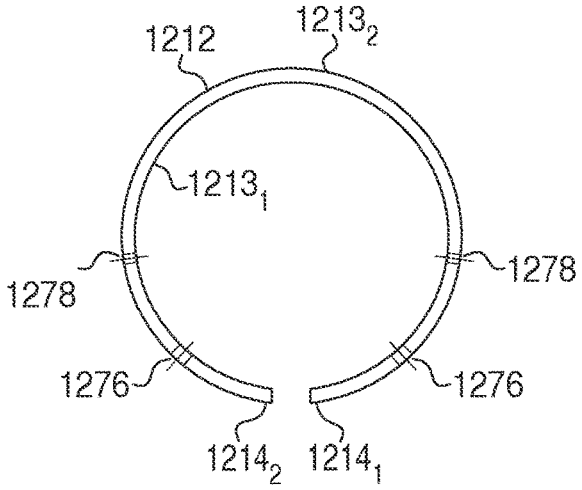
FIG. 95 is a top view of the self-retaining resilient split-ring clamp in accordance with the twelfth exemplary embodiment of the present invention.
Figure 96:
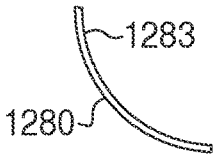
FIG. 96 is a side view of a contoured flap of a manual override adjuster in accordance with the twelfth exemplary embodiment of the present invention.

The manually adjustable, removeable self-retaining device 1204 includes a self-retaining resilient split-ring clamp 1212 and a manual override adjuster 1240 secured to the resilient split-ring clamp 1212. The self-retaining resilient split-ring clamp 1212 is a split (or incomplete) round ring with spaced free ends $\mathbf{1214}_1$ and $\mathbf{1214}_2$, as best shown in FIGS. 94 and 95. Moreover, the resilient split-ring clamp 1212, best shown in FIGS. 92, 93 and 95, has an inner surface $\mathbf{1213}_1$ and an outer surface $\mathbf{1213}_2$. Each of the free ends $\mathbf{1214}_1$ and $\mathbf{1214}_2$ of the self-retaining resilient split-ring clamp 1212 is formed with a threaded hole 1276 and two (2) small through holes 1278 and 1279, as best shown in FIG. 94. The self-retaining resilient split-ring clamp 1212 operates like a spring clamp that is both rigid and flexible and can be made from formable resilient materials including plastics such as ABS or PVC, composites, or spring steel. The self-retaining resilient split-ring clamp 1212 has an inherent spectrum of preloaded tensions that provides automatic pressure adjustments.

Figure 91B:
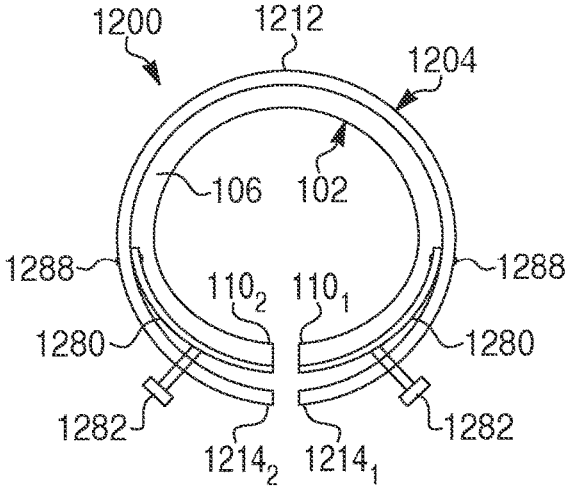
FIG. 91B is a bottom view of the protective pad assembly in accordance with the twelfth exemplary embodiment of the present invention in a contracted position.
Figure 92:
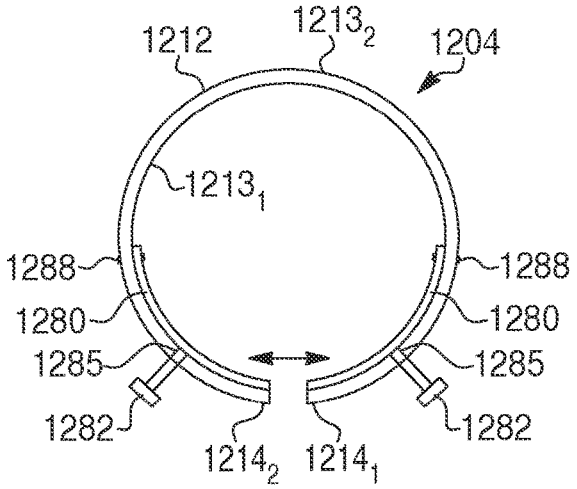
FIG. 92 is a bottom view of a manually adjustable self-retaining device in accordance with the twelfth exemplary embodiment of the present invention in an expanded position.
Figure 93:
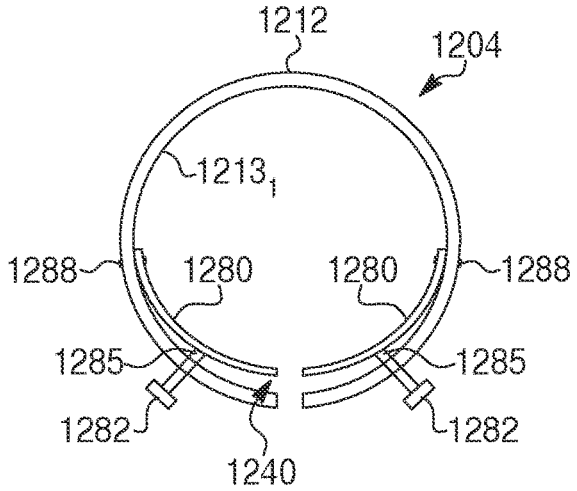
FIG. 93 is a bottom view of the manually adjustable self-retaining device in accordance with the twelfth exemplary embodiment of the present invention in a contracted position.
Figure 97:
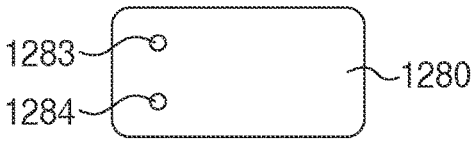
FIG. 97 is a side view of the contoured flap of the manual override adjuster in accordance with the twelfth exemplary embodiment of the present invention.

The manual override adjuster 1240 includes two (2) contoured flaps 1280 each provided with a threaded adjusting member 1282, such as bolt or screw, as best shown in FIGS. 92, 93 and 98. Each of the contoured flaps 1280 has a circumferential shape that matches (i.e., is complementary to) the circumferential shape of the resilient split-ring clamp 1212, as best illustrated in FIGS. 91A and 92. Moreover, each of the contoured flaps 1280 contains two (2) through holes 1283 and 1284, as best shown in FIG. 97, and the through holes 1283 and 1284 of the contoured flap 1280 to line-up with the small through holes 1278 and 1279 of the resilient split-ring clamp 1212. Also, the contoured flaps 1280 and the resilient split-ring clamp 1212 are fastened together permanently with rivets 1288 at each end, as illustrated in FIGS. 91A-93. According to the twelfth exemplary embodiment, the contoured flaps 1280 are pivotally secured to the inner surface $\mathbf{1213}_1$ of the resilient split-ring clamp 1212, as best shown in FIGS. 92 and 93.

The adjusting member 1282 has a threaded shank 1285, as shown in FIG. 98. One adjusting member 1282 is provided on each of the contoured flaps 1280. The threaded shank 1285 of each of the adjusting member 1282 is installed into the threaded hole 1276 on each of the free ends $\mathbf{1214}_1$ and $\mathbf{1214}_2$ of the self-retaining resilient split-ring clamp 1212 until a distal end of the threaded shank 1285 engages an outer peripheral surface of the contoured flap 1280. As a result, the assembly of the manually adjustable self-retaining device 1204 with the manual override adjuster 1240 of the twelfth exemplary embodiment is completed, as best shown FIGS. 92 and 93.

The removeable manually adjustable self-retaining device 1204 with the manual override adjuster 1240 functions by each of the adjusting members 1282 being manually turned clockwise or counterclockwise. FIG. 92 shows a resting position of the adjusting member 1282 and the contoured flaps 1280 engaging the inner surface $\mathbf{1213}_1$ of the resilient split-ring clamp 1212. Turning the threaded adjusting member 1282 clockwise creates tension and pushes on the contoured flap 1280 via the threaded shank 1285 of the adjusting member 1282, and thus displacing the contoured flap 1280 inwardly toward the center of the resilient split-ring clamp 1212, as shown in FIG. 93. When the contoured flaps 1280 are fully inwardly extended, the internal area of the protective cushion pad 106 and the manually adjustable self-retaining device 1204 becomes smaller, as shown FIGS. 91B and 93. Turning the adjusting member 1282 counterclockwise releases the tension on the contoured flaps 1280 and the contoured flaps 1280 retract so that the internal area of the protective cushion pad 106 and the manually adjustable self-retaining device 1204 becomes larger. Thus, when both the contoured flaps 1280 are fully retracted the adjusting member 1282 and the contoured flap 1280 return to their resting places, the internal area of the protective cushion pad 106 and the manually adjustable self-retaining device 1204 is at its largest, as shown in FIG. 92.

It shall be appreciated that the removeable manually adjustable self-retaining device 1204 with the manual override adjuster 1240 in accordance with the twelfth exemplary embodiment is interchangeable and can be used in multiple exemplary embodiments of the outer protective units of the present invention as described herein. For reference purposes, the manually adjustable self-retaining device 1204 of the twelfth exemplary embodiment is mounted to the outer protective unit 102 of the first exemplary embodiment to construct the protective pad assembly 1200 of the twelfth exemplary embodiment and show its functionalities.

The protective pad assembly 1200 of the twelfth exemplary embodiment shown in FIGS. 91A and 91B comprises the flexible protective cushion pad 106 with the flexible side cushion portions $\mathbf{110}_1$ and $\mathbf{110}_2$, and the removeable manually adjustable self-retaining device 1204 with the manual override adjuster 1240. The removeable manually adjustable self-retaining device 1204 is connectable to the flexible protective cushion pad 106 and the flexible side cushion portions $\mathbf{110}_1$ and $\mathbf{110}_2$ thereof by, first, manually opening or spreading of the free ends $\mathbf{1214}_1$ and $\mathbf{1214}_2$ of the self-retaining resilient split-ring clamp 1212, as shown in FIG. 92. Next, the removeable manually adjustable self-retaining device 1204 is placed over the flexible protective cushion pad 106 with the flexible side cushion portions $\mathbf{110}_1$ and $\mathbf{110}_2$, then the free ends $\mathbf{1214}_1$ and $\mathbf{1214}_2$ of the self-retaining resilient split-ring clamp 1212 with the manual override adjuster 1240 are released onto the flexible protective cushion pad 106 to form the protective pad assembly 1200, as shown in FIGS. 91A and 91B.

When the adjusting member 1282 of the removeable manually adjustable self-retaining device 1204 is turned clockwise, the adjusting member 1282 creates tension and pushes on the contoured flap 1280 via the threaded shank 1285 of the adjusting member 1282, extending the contoured flap 1280 and in turn pushing on the flexible protective cushion pad 106. Doing so closes the flexible side cushion portions $\mathbf{110}_1$ and $\mathbf{110}_2$, and thus enables the protective pad assembly 1200 to create more tension and allow incremental adjustments and variable comfort zones for the wearer(user), as shown in shown FIG. 91B. When the adjusting member 1282 of the removeable manually adjustable self-retaining device 1204 is turned counterclockwise, the adjusting members 1282 releases tension and contracts the contoured flap 1280 via the threaded shank 1285 of the adjusting member 1282, releasing the contoured flap 1280 and opening the flexible side cushion portions $\mathbf{110}_1$ and $\mathbf{110}_2$ of the flexible protective cushion pad 106, thus enabling the protective pad assembly 1200 to create less pressure and allow incremental adjustments and variable comfort zones for the wearer(user), as shown in FIG. 91A.

The protective pad assembly in accordance with the present invention makes the wearing of protective pad assemblies easier and faster to put on and more comfortable and minimizes the risk of blood clots and nerve damage due to the strangulation effect of straps tightly pulled around user's limb.

While the exemplary embodiments of the present invention are described with the reference to the knee pad assembly, it will be appreciated that the present invention is equally applicable to other variations and alternative embodiments of the present invention, such as an elbow pad assembly for releasably attaching to a garment, such as shirt or jacket (not shown). The materials used in construction of the protective pad assembly according to the present invention may include a variety of compositions consistent with the function of the invention.

The foregoing description of the exemplary embodiment(s) of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as suited to the particular use contemplated, as long as the principles described herein are followed. This application is therefore intended to cover any variations, uses, or adaptations of the invention using its general principles. Further, this application is intended to cover such departures from the present disclosure as come within known or customary practice in the art to which this invention pertains. Thus, changes can be made in the above-described invention without departing from the intent and scope thereof. It is also intended that the scope of the present invention be defined by the claims appended thereto.

What is claimed is:

1. A protective pad assembly removably positionable on an arm or a leg of a user, the protective pad assembly comprising:

an outer protective unit including a protective cushion pad; and a self-retaining device mounted to the outer protective unit for retaining the outer protective unit on the arm or leg of the user, the self-retaining device including a circular resilient split-ring clamp having two opposite spaced free ends defining a gap therebetween, the resilient self-retaining split-ring clamp having a rectangular cross-section;

the free ends being circumferentially expandable or contractable relative to one another for retaining the outer protective unit on an arm or a leg of the user, and the self-retaining device configured to removably maintain the outer protective unit on the arm or the leg of the user solely by a resilient force of the resilient split-ring clamp of the self-retaining device;

the resilient split-ring clamp is removably mounted over the protective cushion pad;

the protective cushion pad is removably positionable over one of a knee or an elbow of the user.

2. The protective pad assembly as defined in claim 1, wherein the outer protective unit further includes a hard cap non-removably attached to the resilient retaining split-ring clamp, and wherein the hard cap is removably attachable to an outer surface of the protective cushion pad by the resilient retaining split-ring clamp.

3. The protective pad assembly as defined in claim 1, wherein the outer protective unit further includes a hard cap non-removably attached to the protective cushion pad, and wherein the resilient retaining split-ring clamp is disposed between the protective cushion pad and the hard cap.

4. The protective pad assembly as defined in claim 1, wherein the outer protective unit further includes a hard cap non-removably attached to the protective cushion pad, and wherein the resilient retaining split-ring clamp is disposed outside the hard cap.

5. The protective pad assembly as defined in claim 1, wherein the resilient retaining split-ring clamp is embedded into the protective cushion pad.

6. The protective pad assembly as defined in claim 1, wherein the self-retaining device further includes a manual override adjuster mounted to the resilient retaining split-ring clamp, wherein the manual override adjuster is configured to manually adjust a distance between the free ends of the resilient split-ring clamp, and wherein the self-retaining device is removably mounted over the protective cushion pad.

7. The protective pad assembly as defined in claim 6, wherein the manual override adjuster is a gear and rack assembly including a worm gear drive unit secured to one of the free ends of the resilient retaining split-ring clamp, and a toothed rack non-moveably secured to another of the free ends of the resilient retaining split-ring clamp.

8. The protective pad assembly as defined in claim 7, wherein the toothed rack includes a plain rack portion and a rack teeth portion, and wherein the worm gear drive unit includes a base, a worm gear rotatably mounted to the base and meshing with the rack teeth portion of the toothed rack and a thumb knob drivingly connected to the worm gear.

9. The protective pad assembly as defined in claim 8, wherein the base of the worm gear drive unit is non-moveably secured to an outer surface of one of the free ends of the resilient retaining split-ring clamp, and wherein a distal end of the plain rack portion of the toothed rack is non-moveably secured to the outer surface of another of the free ends of the resilient retaining split-ring clamp.

10. The protective pad assembly as defined in claim 9, wherein the self-retaining device includes a plurality of support brackets extending radially inwardly from an inner surface of the resilient retaining split-ring clamp, wherein the support brackets define channels.

11. The protective pad assembly as defined in claim 9, wherein the self-retaining device includes a plurality of cable ties extending through the resilient retaining split-ring clamp.

12. The protective pad assembly as defined in claim 9, wherein the self-retaining device includes a braided cord extending through the resilient retaining split-ring clamp.

13. The protective pad assembly as defined in claim 9, wherein the manual override adjuster is mounted entirely to the outer surface of the resilient retaining split-ring clamp.

14. The protective pad assembly as defined in claim 1, wherein the protective cushion pad has a concave central cushion member and two opposite flexible side cushion members outwardly extending from opposite sides of the central cushion member and formed integrally therewith.

15. The protective pad assembly as defined in claim 14, wherein the self-retaining device further includes a manual override adjuster mounted to the resilient retaining split-ring clamp, wherein the manual override adjuster is configured to manually adjust a distance between the flexible side cushion members of the protective cushion pad.

16. The protective pad assembly as defined in claim 15, wherein the manual override adjuster includes two contoured flaps each pivotally secured to an inner surface of the resilient retaining split-ring clamp and two threaded adjusting members each engaging an outer peripheral surface of one of the contoured flaps, wherein each of the contoured flaps has a radial shape that is complementary to the radial shape of the resilient retaining split-ring clamp, wherein an inner peripheral surface of each of the contoured flaps engages an outer surface of one of the flexible side cushion members of the protective cushion pad, and wherein the threaded adjusting members of the manual override adjuster is configured to manually adjust a distance between the flexible side cushion members of the protective cushion pad by manually by manually turning each of the adjusting members clockwise or counterclockwise.

17. The protective pad assembly as defined in claim 1, wherein each of the free ends of the resilient retaining split-ring clamp is provided with a flexible cushion pad secured to an inner surface of the resilient retaining split-ring clamp, and wherein the flexible cushion pads are disposed outside of the protective cushion pad.

18. The protective pad assembly as defined in claim 1, wherein the protective cushion pad has a concave central cushion portion and two opposite flexible side cushion members outwardly extending from opposite sides of the central cushion member, and wherein each of the opposite free ends of the resilient split-ring clamp engages one of the opposite flexible side cushion members of the protective cushion pad.

19. The protective pad assembly as defined in claim 18, wherein the resilient split-ring clamp is removably mounted over the protective cushion pad so that the opposite free ends of the resilient split-ring clamp engage the flexible side cushion members of the protective cushion pad.

20. The protective pad assembly as defined in claim 18, wherein the resilient retaining split-ring clamp is non-removably mounted over the protective cushion pad so that the opposite free ends of the resilient split-ring clamp engage the flexible side cushion members of the protective cushion pad.

21. The protective pad assembly as defined in claim 1, comprising a single resilient split-ring clamp.

22. The protective pad assembly as defined in claim 21, wherein the protective cushion pad has an upper end and a lowed end, and the single resilient split-ring clamp is disposed at the lower end.

* * * * *